US005540031A

United States Patent [19]

Ozeki et al.

[11] Patent Number: 5,540,031

[45] **Date of Patent: *Jul. 30, 1996**

[54] COIN WRAPPING MACHINE

[75] Inventors: Masamichi Ozeki, Ashikaga; Mamoru Takasaki, Kazo; Katsuyuki Miyamoto, Kawaguchi; Mitsumasa Tsuruda, Oomiya, all of Japan

[73] Assignee: Laural Bank Machines Co., Ltd., Tokyo, Japan

[ * ] Notice: The term of this patent shall not extend beyond the expiration date of Pat. No. 5,487,252.

[21] Appl. No.: 226,509

[22] Filed: Apr. 12, 1994

[30] Foreign Application Priority Data

Apr. 15, 1993 [JP] Japan ..... 5-088700

[51] Int. Cl.[6] ..... B65B 11/04

[52] U.S. Cl. ..... 53/212; 53/532

[58] Field of Search ..... 53/212, 500, 501, 53/532, 535; 453/31, 61, 62; 194/344

[56] References Cited

U.S. PATENT DOCUMENTS

| | | | |
|---|---|---|---|
| 3,938,303 | 2/1976 | Ushio et al. | 53/212 |
| 4,049,011 | 9/1977 | Nakai et al. | 53/212 |
| 4,058,955 | 11/1977 | Nakai et al. | 53/212 |
| 4,383,541 | 5/1983 | Uchida . | |
| 4,832,655 | 5/1989 | Sakurai . | |
| 5,002,516 | 3/1991 | Watanabe et al. | 53/212 |

FOREIGN PATENT DOCUMENTS

| | | |
|---|---|---|
| 357156 | 3/1990 | European Pat. Off. . |
| 1449051 | 4/1964 | Germany . |
| 62-208329 | 9/1987 | Japan . |
| 2066532 | 7/1981 | United Kingdom . |

OTHER PUBLICATIONS

Chemical Patents Index, Documentation Abstracts Journal, Week 9215, Derwent Publications Ltd. AN 92–118314 & JP–A–04 059 706, Feb. 26, 1992.

Chemical Patents Index, Documentation Abstracts Journal, Week 9150, Derwent Publications Ltd., AN 91–365775 & JP–A–03 246 204, Nov. 1, 1991.

*Primary Examiner*—John Sipos
*Assistant Examiner*—Ed Tolan
*Attorney, Agent, or Firm*—Cushman, Darby & Cushman

[57] ABSTRACT

A coin stacker for stacking coins to be wrapped includes a pair of stacking blocks each being movable relative to the other perpendicular to a vertical plane including the center line of a coin sorting passage for passing coins of a predetermined denomination therethrough. The first stacking block includes a first inner wall section lying at an angle X to the direction in which the coin sorting passage extends and a second inner wall section lying at an angle -X to the vertical plane including the center line of the coin sorting passage. The second inner wall section is higher than the first inner wall section in the direction in which the coins are stacked. The second stacking block includes a first inner wall section and a second inner wall section. The first inner wall section thereof and the first inner wall section of the first stacking block are formed symmetrically with respect to the center line of the coin sorting passage, and the second inner wall section thereof and the second inner wall section of the first stacking block are formed symmetrically with respect to the center line of the coin sorting passage. The second inner wall section thereof is higher than the first inner wall section thereof in the direction in which the coins are stacked.

11 Claims, 16 Drawing Sheets

FIG. 13A DETECTION SIGNAL OF PHOTOSENSOR

FIG. 13B POST ELEVATING AND LOWERING CAM

FIG. 13C POST RETRACTING CAM

FIG. 13D FIRST WRAPPING ROLLER POSITION ADJUSTING CAM

FIG. 13E CRIMP CLAW RETRACTING CAM

COIN WRAPPING MACHINE

BACKGROUND OF THE INVENTION

The present invention relates to a coin wrapping machine and, in particular, to a coin wrapping machine comprising a rotatable disk for receiving deposited coins and feeding out the received coins of a predetermined denominations to a coin sorting passage by the centrifugal force produced by rotation thereof. Coin stacking means stacks coins to be wrapped, and coin support post means receives coins stacked in the coin stacking means at a post waiting position immediately below the coin stacking means and supports them on the upper surface thereof. The coin wrapping means includes a plurality of wrapping rollers for winding a wrapping film around the stacked coins supported by the coin support post means to wrap them and produce a wrapped coin roll. Support post moving means moves the coin support post means between the post waiting position immediately below the coin stacking means, a post wrapping position where the coins supported on the upper surface of the coin support post means can be wrapped by the coin wrapping means, and a post retracted position where the coin support post means is retracted from between the plurality of wrapping rollers. Wrapping rollers moving means moves the plurality of wrapping rollers between wrapping roller wrapping positions where the coins are wrapped and wrapping roller retracted positions.

DESCRIPTION OF THE PRIOR ART

A coin wrapping machine is generally constituted so as to feed deposited coins to be wrapped from a coin passage to a coin stacking means having a pair of stacking drums, to stack a predetermined number of the coins by the rotation of the pair of stacking drums while the coins are supported by the upper surfaces of helical coin guides formed on the surface of the pair of stacking drums, to transport the stacked coins onto the upper surface of a coin support post which is on standby at a predetermined position, and to lower the coin support post into a coin wrapping means located below the coin stacking means and having a plurality of wrapping rollers, whereafter the wrapping rollers wind a wrapping film around the stacked coins supported by the upper surface of the coin support post so as to wrap the predetermined number of coins.

In this type of coin wrapping machine, as disclosed for example in Japanese Patent Application laid open No. 62-208329, in order to wrap coins of different denominations having various diameters, the pair of stacking drums can be moved relative to each other in accordance with the diameter of the coins to be wrapped and a guide member provided downstream of the pair of stacking drums which allows the coins to be stacked between the pair of stacking drums can be moved in accordance therewith.

However, in such a coin wrapping machine, when each of the pair of stacking drums is moved relative to the other in accordance with the diameter of the coins to be wrapped, the guide member is not moved in synchronism with the movement of the stacking drums so as to precisely position the center of the coins to be wrapped above that of the upper surface of the coin support post in the waiting position thereof, whereby when the coins to be wrapped are stacked by the pair of stacking drums and transported onto the upper surface of the coin support post positioned in the center portion between the pair of stacking drums, the center of the stacked coins may not coincide with the center of the upper surface of the coin support post. Consequently, when the stacked coins are held by the plurality of wrapping rollers, the surfaces of the coins are not perpendicular to those of the wrapping rollers, and therefore, the coins may be obliquely wrapped.

This causes a serious problem, especially when the diameter of the coins to be wrapped varies greatly with denomination.

SUMMARY OF THE INVENTION

It is therefore an object of the present invention to provide a coin wrapping machine which comprises a rotatable disk for receiving deposited coins and feeding out the received coins to a coin sorting passage by the centrifugal force produced by rotation thereof, the coin sorting passage being for passing coins of a predetermined denomination therethrough, coin stacking means for stacking coins to be wrapped, coin support post means for receiving coins stacked in the coin stacking means at a post waiting position immediately below the coin stacking means and supporting them on the upper surface thereof. The coin wrapping means includes a plurality of wrapping rollers for winding a wrapping film around the stacked coins supported by the coin support post means to wrap them and produce a wrapped coin roll, and support post moving means for moving the coin support post means between the post waiting position immediately below the coin stacking means, a post wrapping position where the coins supported on the upper surface of the coin support post means can be wrapped, and a post retracted position where the coin support post means is retracted from between the plurality of wrapping rollers. Wrapping roller moving means moves the plurality of wrapping rollers between wrapping roller wrapping positions where the coins are wrapped and wrapping roller retracted positions. According to the present invention, coins of different denominations having various diameters can be wrapped as desired by means of simple mechanisms.

The above and other objects of the present invention can be accomplished by a coin wrapping machine comprising a rotatable disk for receiving deposited coins and feeding out the received coins to a coin sorting passage by the centrifugal force produced by rotation thereof, the coin sorting passage for passing coins of a predetermined denomination therethrough, coin stacking means for stacking coins to be wrapped, and coin support post means for receiving coins stacked in the coin stacking means at a post waiting position immediately below the coin stacking means and supporting them on the upper surface thereof. The coin wrapping means includes a plurality of wrapping rollers for winding a wrapping film around the stacked coins supported by the coin support post means to wrap them and produce a wrapped coin roll. The coin wrapping means also includes support post moving means for moving the coin support post means between the post waiting position immediately below the coin stacking means, a post wrapping position where the coins supported on the upper surface of the coin support post means can be wrapped by the coin wrapping means and a post retracted position where the coin support post means is retracted from between the plurality of wrapping rollers. Wrapping roller moving means moves the plurality of wrapping rollers between wrapping roller wrapping positions where the coins are wrapped and wrapping roller retracted positions. The coin stacking means includes a pair of stacking block means each being movable relative to the other perpendicular to the direction in which the coin sorting passage extends, wherein the first stacking block means includes a first inner wall section lying at an angle X to the direction in which the coin sorting passage extends and a second inner wall section lying at an angle −X to the direction in which the coin sorting passage extends, the second inner wall section being higher than the first inner wall section in the direction in which the coins are stacked. The second stacking block means includes a first inner wall section and a second inner wall section, the first inner wall section thereof and the first inner wall section of the first stacking block being formed symmetrically with respect to the center line of the coin sorting passage, the second inner wall section thereof and the second inner wall section of the first stacking block being formed symmetrically with respect to the center line of the coin sorting passage, and the second inner wall section thereof being higher than the first inner wall section thereof in the direction in which the coins are stacked.

In a preferred aspect of the present invention, the coin sorting passage is defined by a pair of guide members. The wrapping machine further comprises passage width adjusting means for moving the pair of guide members relative to each other to adjust the spacing therebetween, and stacking block spacing adjusting means for moving the pair of stacking block means relative to each other in synchronism with the operation of the passage width adjusting means to adjust the spacing therebetween.

In another preferred aspect of the invention, the stacking block spacing adjusting means is adapted to move the pair of stacking block means such that the amount of movement of the pair of stacking blocks is (1/cosX) times that of the passage width adjusting means.

In a further preferred aspect of the invention, the angle X associated with the pair of stacking block means satisfies the condition of $30<=X<=60$.

In a still further preferred aspect of the invention, the angle X associated with the pair of stacking block means is approximately 45.

In yet another preferred aspect of the invention, the coin wrapping machine further comprises a shutter means which can be opened and closed at a bottom portion of the coin stacking means.

In a further preferred aspect of the invention, each of the pair of stacking block means includes a third inner wall section parallel to the direction in which the coin sorting passage extends, whereby the pair of stacking block means are constituted to form a hexagon when they come into abutment.

The above and other objects and features of the present invention will become apparent from the following description made with reference to the accompanying drawings.

BRIEF DESCRIPTION OF THE DRAWINGS

FIG. 8A and 8B are schematic front view of stacking blocks used in the coin wrapping machine which is an embodiment of the present invention, in which FIG. 8A shows the stacking blocks abutting against each other, and FIG. 8B shows them apart from each other.

DESCRIPTION OF THE PREFERRED EMBODIMENTS

Figure 1:
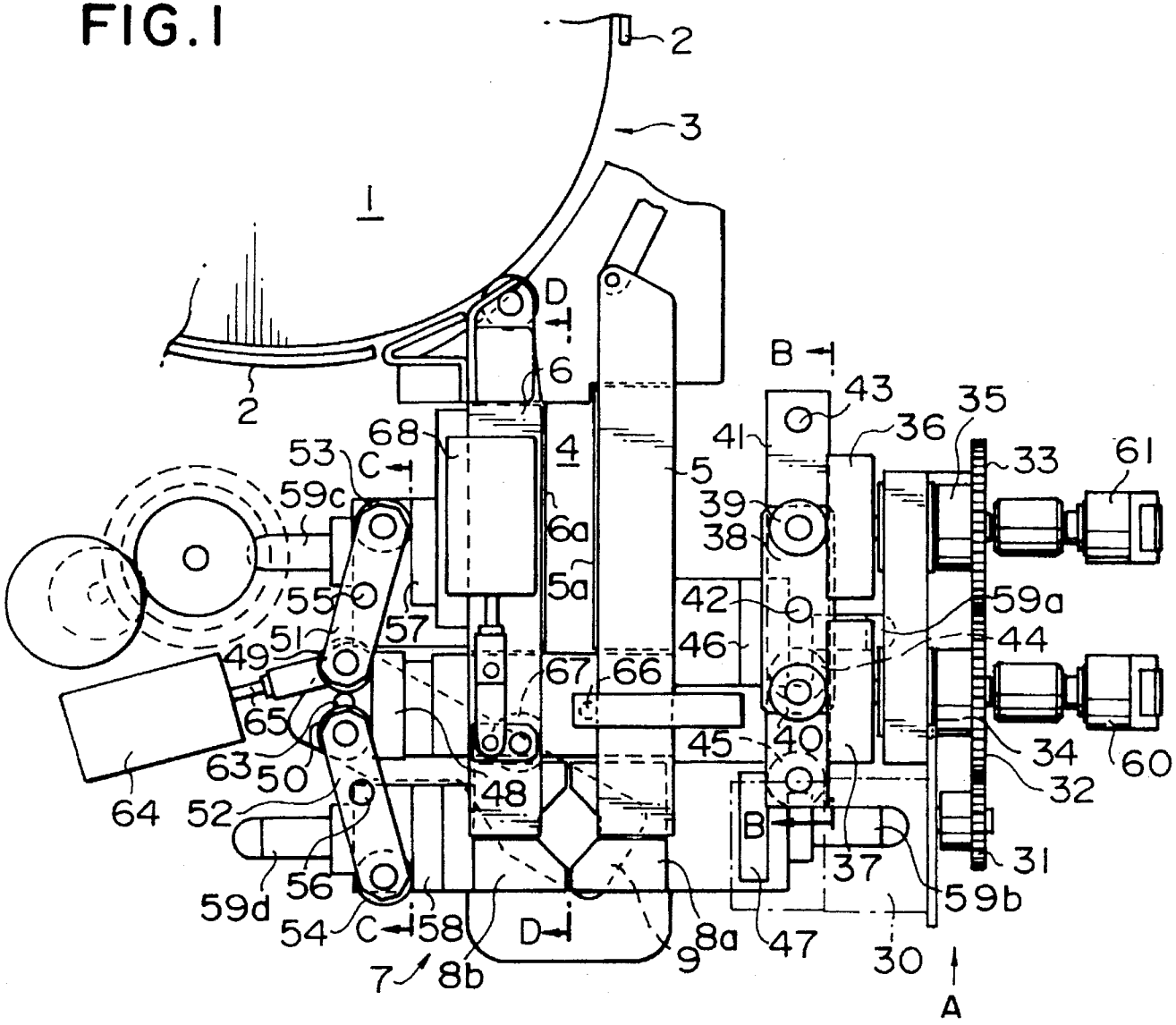
FIG. 1 is a schematic plan view of a coin sorting passage and a coin stacking portion of a coin wrapping machine which is an embodiment of the present invention.

As shown in FIG. 1, a coin wrapping machine which is an embodiment of the present invention is adapted for counting or for counting and wrapping coins of a specific denomination. Coins deposited through a coin depositing section (not shown) into the coin wrapping machine are fed by a transporting belt (not shown) onto a rotatable disk 1. An annular guide member 2 is connected at the circumferential edge portion of the rotatable disk 1 and a coin sorting passage 4 is connected to an opening 3 of the annular guide member 2 in a well known manner.

The coin sorting passage 4 is formed by a pair of guide members 5, 6 and a transporting belt (not shown) described later, and the lower edge portions of the guide members 5, 6 are formed with facing shelf-like coin supporting portions *5a*, *6a* for supporting coins to be counted or to be counted and wrapped on the upper surfaces thereof. The space between the pair of guide members 5, 6 is adjustable by a passage width adjusting motor described later so that only coins to be counted or to be counted and wrapped are supported by the coin supporting portions *5a*, *5b* to pass through the coin sorting passage 4. Coins larger than the coins to be counted or to be counted and wrapped remain on the rotatable disk 1 while coins smaller than those to be counted fall through the space between the pair of guide members 5, 6 to be collected.

A coin temporary stacking section 7 is provided downstream of the coin sorting passage 4 and includes a pair of movable stacking blocks 8*a*, 8*b* and a shutter 9 disposed below the pair of stacking blocks 8*a*, 8*b*. When the shutter 9 is opened, the space between the pair of stacking blocks 8*a*, 8*b* opens downward and when the shutter is closed, the pair of stacking blocks 8*a*, 8*b* and the shutter 9 form a stacking section for temporarily stacking coins. The coin temporary stacking section 7 is constituted to form a hexagon when the pair of stacking blocks 8*a*, 8*b* come into abutment. Namely, the facing inner surfaces of the pair of stacking blocks 8*a*, 8*b* each consists of a first inner wall 8*a*-1, 8*b*-1 lying at an angle of 45 degrees to the direction in which the coin sorting passage 4 extends, a second inner wall 8*a*-2, 8*b*-2 lying at an angle of 135 degrees to the direction in which the coin sorting passage 4 extends.

A coin wrapping section to be described later is provided below the shutter 9.

Figure 2:
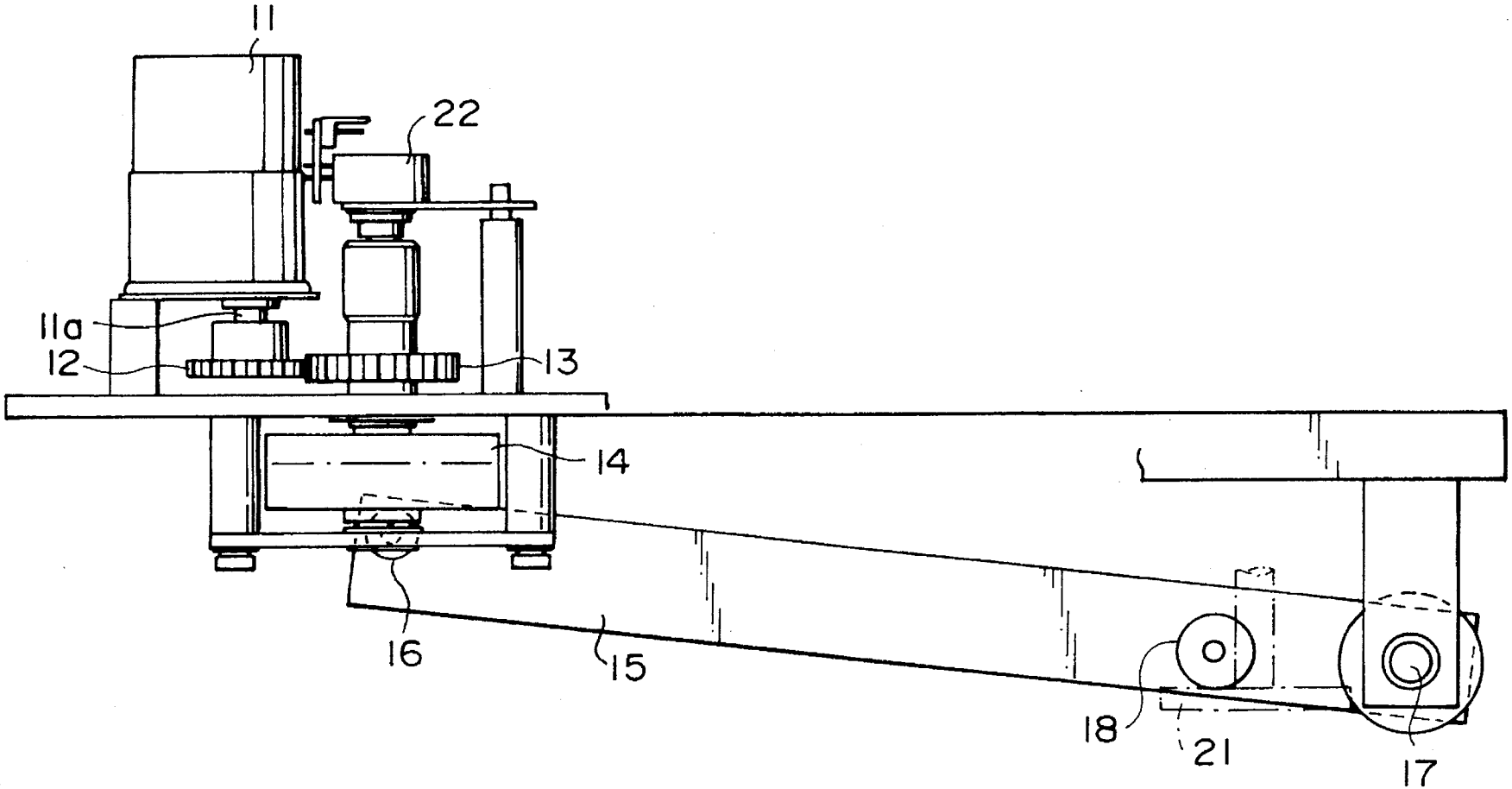
FIG. 2 is a schematic side view showing a transporting belt position adjusting mechanism used in the coin wrapping machine which is an embodiment of the present invention for adjusting the vertical position of a transporting belt.
Figure 3:
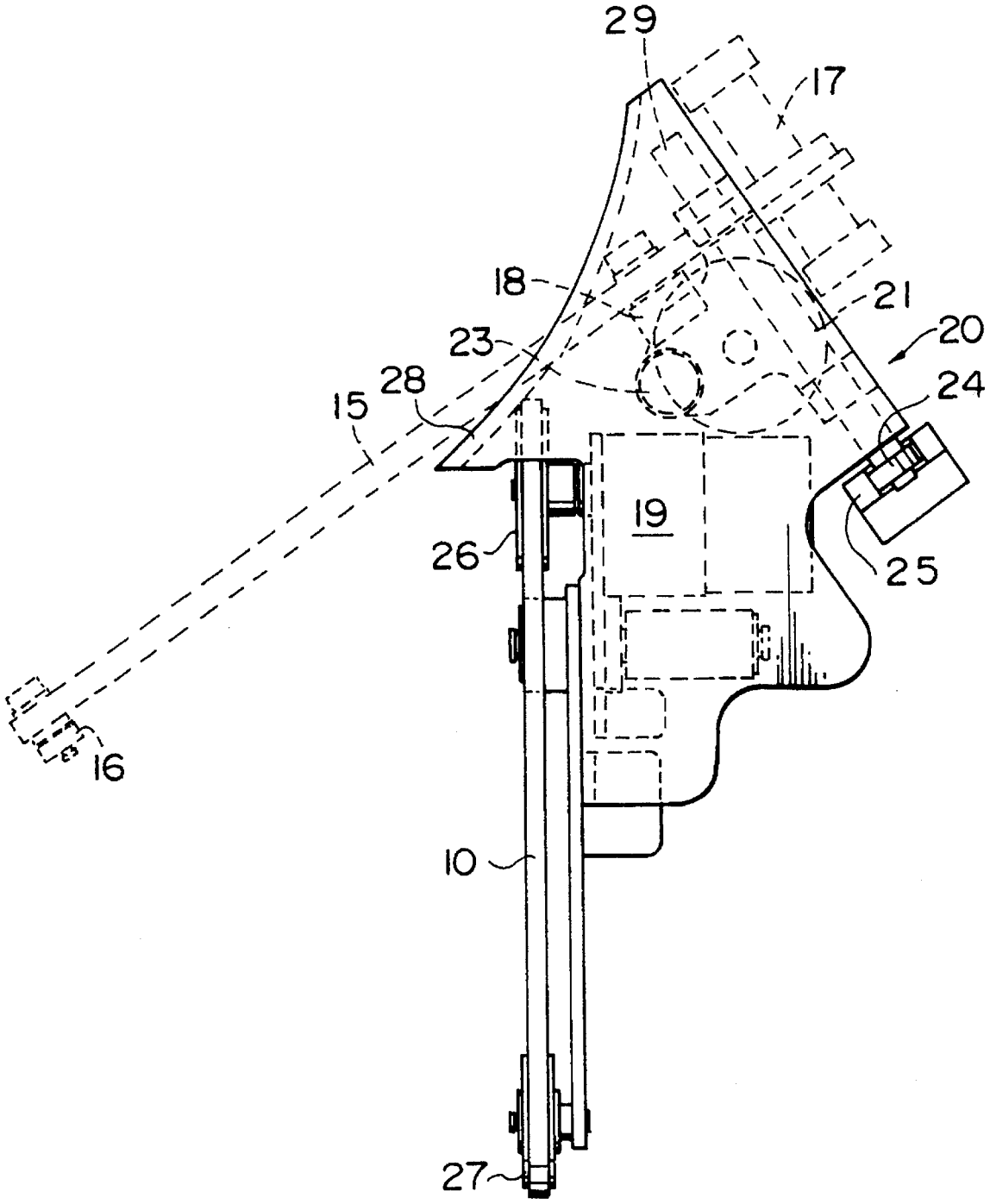
FIG. 3 is a schematic plan view showing a transporting belt position adjusting mechanism used in the coin wrapping machine which is an embodiment of the present invention for adjusting the vertical position of a transporting belt.

FIG. 2 is a schematic side view showing a transporting belt position adjusting mechanism for adjusting the vertical position of a transporting belt 10 forming the coin sorting passage 4 together with the pair of guide members 5, 6 for transporting coins and FIG. 3 is a schematic plan view thereof.

The transporting belt position adjusting mechanism is adapted for adjusting the vertical position of the transporting belt 10 so as to correspond to the thickness of coins to be counted or to be counted and wrapped. As shown in FIG. 2, the transporting belt position adjusting mechanism includes a motor 11 and the output shaft 11*a* of the motor is connected to a gear 12 meshed with a gear 13. A cam 14 is connected to the gear 13 and a cam follower 16 mounted on one end portion of lever 15 abuts against the cam 14. As shown in FIGS. 2 and 3, a shaft 17 fixed to the body of the coin wrapping machine passes through the other end portion of the lever 15 and the lever 15 is swingable about the shaft 17. A roller 18 is secured to the lever 15 in the vicinity of the shaft 17 and a circular connecting plate 21 abuts on the lower surface of the roller 18. The circular connecting plate 21 is integrally formed with a transporting belt unit 20 including the transporting belt 10 and a motor 19 for driving the transporting belt 10. Consequently, when the motor 11 is driven, the driving force of the motor 11 is transmitted to the cam via the output shaft 11*a*, the gear 12 and the gear 13, whereby the cam 14 is rotated and the cam follower 16 is moved vertically by the lobe of the cam 14. As a result, the lever 15 is swung about the shah 17 and the connecting plate 21 is moved vertically by the roller 18, whereby the vertical position of the transporting belt unit 20 integrally formed with the connecting plate 21, and, therefore, that of the transporting belt 10 are adjusted. A rotary encoder 22 is connected to the gear 13 and is adapted for detecting the amount of rotation of the gear 13, namely, the vertical position of the transporting belt 10. In FIG. 3, the reference numeral 23 designates a guide pin, the reference numeral 24 designates a roller and the reference numeral 25 designates a slide rail abutting against the roller 24. These members support the transporting belt unit 20 to be vertically movable.

As shown in FIG. 3, the transporting belt 10 is entrained around a drive pulley 26 and a driven pulley 27 and is adapted to hold coins between the lower surface thereof and the coin supporting portions 5*a*, 5*b* and transport them. In FIG. 3, the reference numeral 28 designates a gap regulating member which is disposed at the opening 3 of the annular guide member 2 such that the spacing between itself and the rotatable disk 1 is greater than the thickness of the thickest coin to be counted or to be counted and wrapped and narrower than double the thickness of the thinnest coin to be counted or to be counted and wrapped. As a consequence, when the vertical position of the transporting belt 10 is adjusted by the transporting belt position adjusting mechanism so as to correspond to the thickness of the coins to be counted or to be counted and wrapped, the vertical position of the gap regulating member 28 is simultaneously adjusted so as to prevent two or more coins from being simultaneously fed from the rotatable disk 1 into the coin sorting passage 4. Further, the transporting belt unit 20 includes a support shaft 29 mounted on the body of the coin wrapping machine so as to be vertically movable and can be opened and closed about the support shaft 29. Therefore, if coin jamming or some other trouble occurs, it is possible to remove the jammed coins by opening the transporting belt unit 20 about the support shaft 29.

Figure 4:
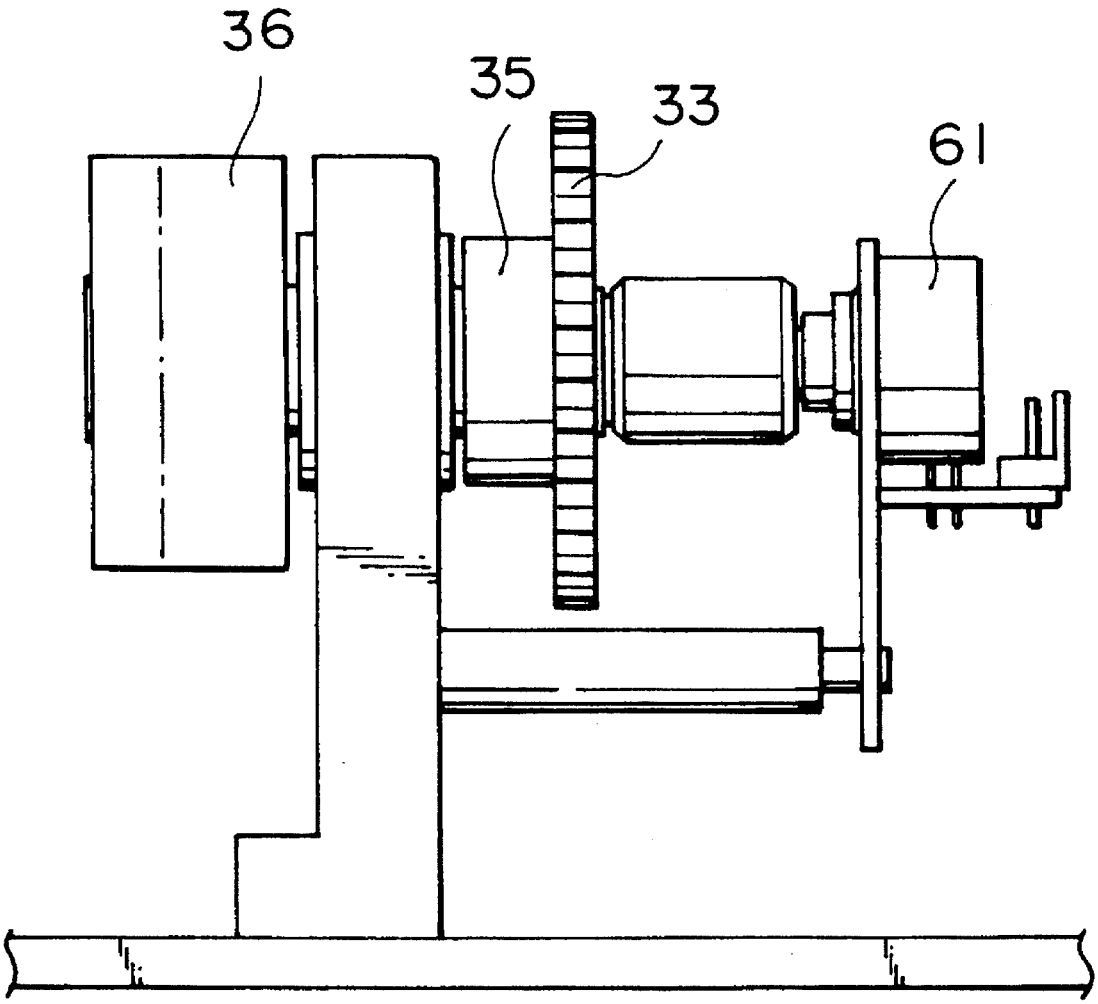
FIG. 4 is a schematic side view in the direction indicated by the arrow A in FIG. 1, showing a passage width adjusting mechanism used in the coin wrapping machine which is an embodiment of the present invention.

FIG. 4 is a schematic side view in the direction indicated by an arrow A in FIG. 1 and shows a passage width adjusting mechanism for adjusting the passage width of the coin sorting passage 4, namely, the spacing between the pair of guide members 5, 6 so as to be suitable for the diameter of the coins to be counted or to be counted and wrapped.

Figure 5:
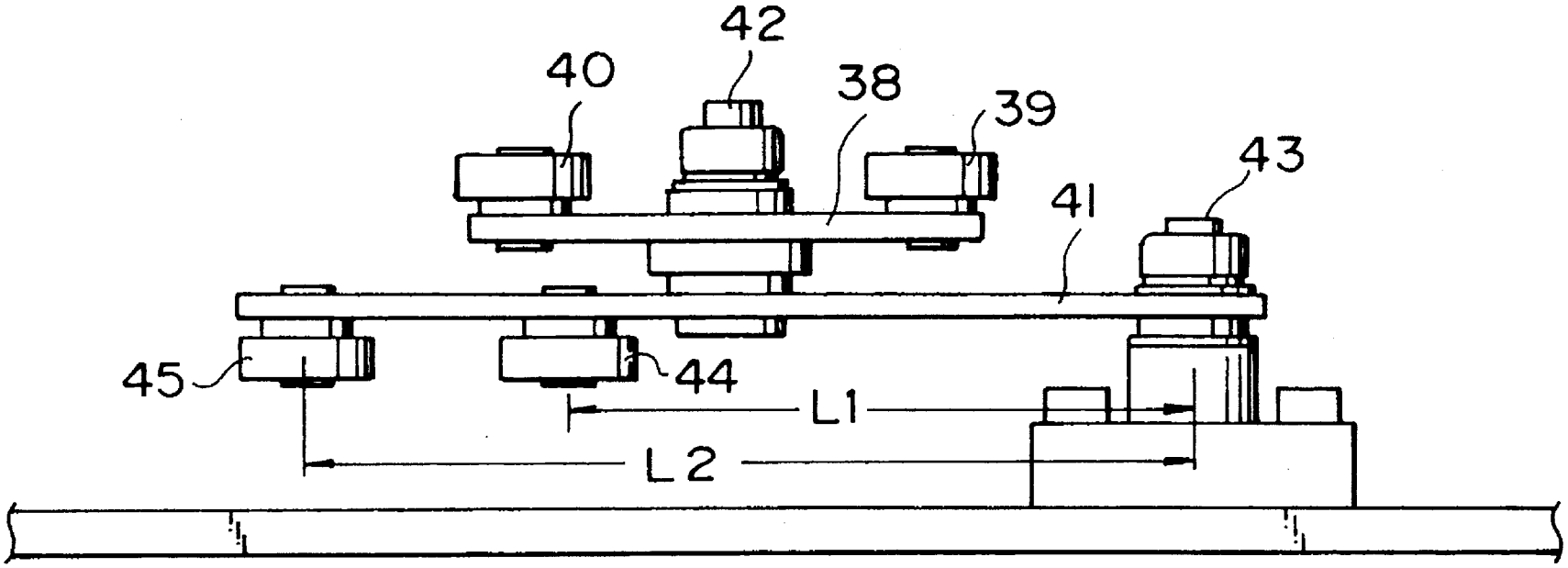
FIG. 5 is a schematic cross sectional view taken along line B—B in FIG. 1.

As shown in FIG. 1, the passage width adjusting mechanism includes a motor 30, and a drive gear 31 connected to the output shaft of the motor 30 and meshing with a gear 32 which meshes with a gear 33. The gears 32, 33 are respectively connected to a rough adjustment cam 37 and a fine adjustment cam 36 via one-way clutches 34, 35. The lobe of the rough adjustment cam 37 is formed to have greater unevenness than that of the fine adjustment cam 36. The cam surfaces of the rough adjustment cam 37 and the fine adjustment cam 36 respectively abut against cam followers 40, 39 mounted in the vicinity of the opposite end portions of an elongated plate 38. As shown in FIG. 5, which is a schematic cross sectional view taken along line B—B in FIG. 1, a swing arm 41 is disposed below the plate 38 and a shaft 42 fixed to the central portion of the swing arm 41 and extends upwardly so as to swingably support the plate 38 at the central portion thereof. The swing arm 41 is swingable about a shaft 43 provided at one end portion thereof. The underside of the swing arm 41 is provided with a first roller 44 spaced from the shaft 43 by the distance L1 and a second roller 45 spaced from the shaft 43 by the distance L2. The ratio of L1 to L2 is $1:2^{1/2}$. The first roller 44 abuts against one side surface of a rectangular parallelepiped-like movable plate 46 formed integrally with the guide member 5 to stand erect thereon. On the other hand, the second roller 45 abuts against a rectangular parallelepiped-like movable plate 47 formed integrally with the stacking block 8*a* to stand erect thereon. The movable plate 46 is biased to the right in FIG. 1 by a spring (not shown) so as to broaden the width of the coin sorting passage 4 and the movable plate 47 is biased to the right in FIG. 1 by a spring (not shown) so as to move the stacking block 8*a* apart from the other stacking block 8*b*.

Figure 6:
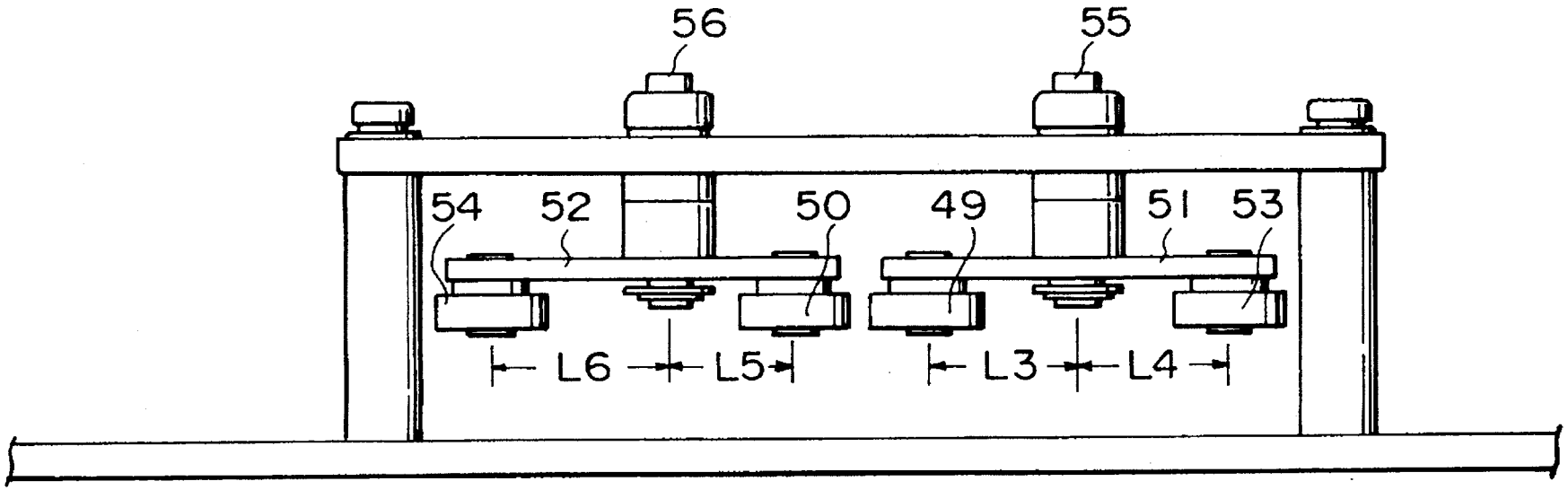
FIG. 6 is a schematic cross sectional view taken along line C—C in FIG. 1.

On the opposite side of the coin sorting passage from the movable plate 46, a rectangular parallelepiped-like movable plate 48 is formed integrally with the guide member 5 to stand erect thereon. The movable plate 48 abuts against a roller 49 and a roller 50. The roller 49 is rotatably mounted in the vicinity of one end portion of a link 51 and the roller 50 is rotatably mounted in the vicinity of one end portion of a link 52. A roller 53 is rotatably mounted in the vicinity of the other end portion of the link 51 and a roller 54 is rotatably mounted in the vicinity of the other end portion of the link 52. As shown in FIG. 6, which is a schematic cross sectional view taken along line C—C in FIG. 1, the link 51 is swingable about a shaft 55 which is spaced apart from the shaft of the roller 49 by the distance L3 and from the shaft of the roller 53 by the distance L4. The link 52 is swingable about a shaft 56 which is spaced from the shaft of the roller 50 by the distance L5 and from the shaft of the roller 54 by the distance L6. L3 is equal to L4 and the ratio of L5 to L6 is set to be $1:2^{1/2}$. The roller 53 abuts against one side surface of a rectangular parallelepiped-like movable plate 57 formed integrally with the guide member 6 to stand erect thereon. The movable plate 57 is biased to the left in FIG. 1 by a spring (not shown) so as to broaden the width of the coin sorting passage 4. The roller 54 abuts against one side surface of a rectangular parallelepiped-like movable plate 58 formed integrally with the other stacking block **8*b* to stand erect thereon at a position relative to the coin temporary stacking section 7 corresponding to that of the movable plate 47 of the stacking block 8*a*. The movable plate 58 is biased to the left in FIG. 1 by a spring (not shown) so as to move the stacking block 8*a* apart from the other stacking block 8*b*. In FIG. 1, the reference numerals 59*a*, 59*b*, 59*c* and 59*d* respectively designate slide rails and the reference numerals 60 and 61** designate rotary encoders.

The motor 30 can rotate the drive gear 31 in forward and backward directions by 360 degrees. The one-way clutch 35 transmits the rotating force to the fine adjustment cam 36 only when the gear 33 is rotated, for example, in the forward direction and the one-way clutch 34 transmits the rotating force to the rough adjustment cam 37 only when the gear 32 is rotated, for example, in the forward direction. Therefore, when the drive gear 31 is rotated by the motor 30 in the backward direction, for example, the rotating force of the motor 30 is transmitted to the rough adjustment cam 37 via the gear 32 and the one-way clutch 34. On the other hand, when the drive gear 31 is rotated by the motor 30 in the forward direction, for example, the rotating force of the motor 30 is transmitted to the fine adjustment cam 36 via the gear 32, the gear 33 and the one-way clutch 35.

In the thus constituted passage width adjusting mechanism, prior to a counting operation or counting and wrapping operations for coins of a specified denomination, the width of the coin sorting passage 4 and the diameter of the coin temporary stacking section 7 are adjusted so as to correspond to the diameter of the denomination of the coins to be counted or to be counted and wrapped in the following manner.

At first, the motor 30 rotates the drive gear 31 in the backward direction by a predetermined angle, thereby rotating the rough adjustment cam 37 in the forward direction via the gear 32. Although the gear 33 is also rotated, since the one-way clutch 35 is interposed between the fine adjustment cam 36 and the gear 33, the fine adjustment cam 36 is not rotated. When the operation is started, the width of the coin sorting passage 4, namely, the spacing between the pair of guide members 5, 6 is set to be maximum and, as a result, the cam follower 40 which abuts against the rough adjustment cam 37 formed with the lobe having greater unevenness is rotated and pressed to the left in FIG. 1, whereby the elongated plate 38 is swung about the shaft 42. Since the shaft 42 is fixed to the swing arm 41 and the cam follower 39 abuts against the fine adjustment cam 36 and is prevented from moving to the right in FIG. 1, the swing arm 41 is swung about the shaft 43 clockwise in FIG. 1, whereby the first roller 44 mounted on the swing arm 41 pushes the movable plate 46 to the left in FIG. 1 and the second roller 45 pushes the movable plate 47 to the left in FIG. 1. As a result, the guide member 5 integrally formed with the movable plate 46 is moved to the left in FIG. 1 against the force of a spring (not shown) and the stacking block **8*a* integrally formed with the movable plate 47 is moved to the left in FIG. 1 against the force of a spring (not shown). At the same time, similarly to the movable plate 46, the movable plate 48 integrally formed with the guide member 5 is moved to the left in FIG. 1 and the roller 49 and the roller 50 which abut against the movable plate 48 are pushed by the movable plate 48 so that the link 51 is swung about the shaft 55 clockwise in FIG. 1 and that the link 52 is swung about the shaft 56 counterclockwise in FIG. 1. Consequently, the roller 53 pushes the movable plate 57 and the roller 54 pushes the movable plate 58 to the right in FIG. 1, whereby the guide member 6 integrally formed with the movable plate 57 and the stacking block 8*b* integrally formed with the movable plate 58 are moved to the right in FIG. 1. Since, as explained above, the ratio of the distance L1 between the shaft of the first roller 44 and the shaft 43 to the distance L2 between the shaft of the second roller 45 and the shaft 43 is set to be $1:2^{1/2}$, the ratio of the moving distance of the movable plate 46 and accordingly the guide member 5 to the moving distance of the movable plate 47 and accordingly the stacking block 8*a* is equal to $1:2^{1/2}$. On the contrary, since the distance L3 between the shaft of the roller 49 and the shaft 55 and the distance L4 between the shaft of the roller 53 and the shalt 55 arc equal, the moving distance of the movable plate 57 caused by the movement of the movable plate 48 integrally formed with the movable plate 46 is equal to the moving distance of the movable plate 46 and, therefore, the moving distance of the guide member 6 is equal to the moving distance of the guide member 5. On the other hand, since the ratio of the distance L5 between the shaft of the roller 50 and the shaft 56 to the distance L6 between the shaft of the roller 54 and the shaft 56 is set to be $1:2^{1/2}$, the ratio of the moving distance of the movable plate 48, namely, the moving distance of the movable plate 57 to the moving distance of the movable plate 58 is equal to $1:2^{1/2}$ and the ratio of the moving distance of the guide member 6 to the moving distance of the stacking block 8*b*** is also equal to $1:2^{1/2}$.

Figure 7:
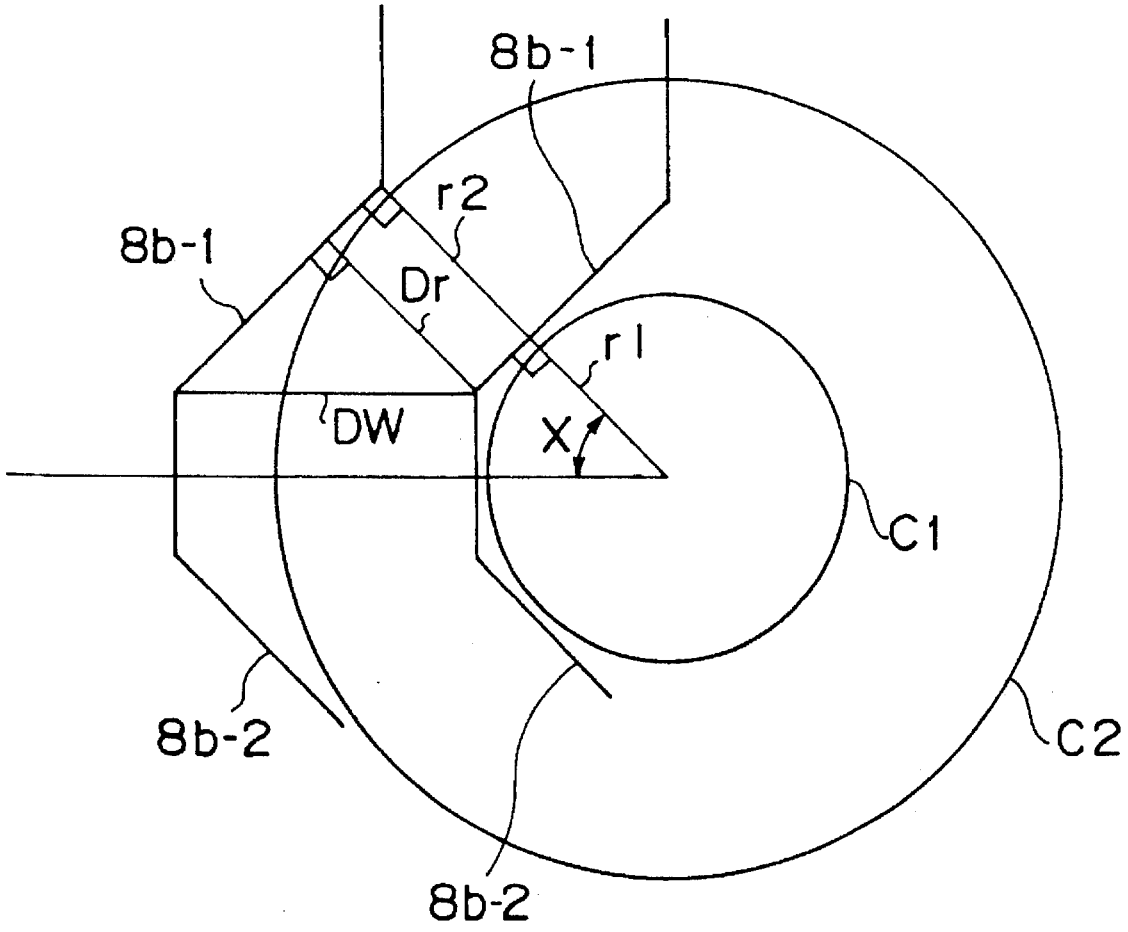
FIG. 7 is a schematic front view of stacking blocks used in the coin wrapping machine which is an embodiment of the present invention, showing the movement of the stacking blocks.

After the rough adjustment cam 37 has been rotated to move the guide members 5, 6 and the stacking blocks **8*a*, 8*b* toward each other by a relatively great distance, the motor 30 rotates the drive gear 31 in the forward direction. Since the one-way clutch 34 is interposed between the gear 32 and the rough adjustment cam 37, the driving force of the motor 30 is no longer transmitted to the rough adjustment cam 37, while, on the other hand, the fine adjustment cam 36 is rotated in the forward direction via the gear 32, the gear 33 and the one-way clutch 35. As described above, the cam follower 39 mounted on the plate 38 abuts on the fine adjustment cam 36 and is pushed to the left in FIG. 1 while it is being rotated, whereby the plate 38 is swung about the shaft 42. Since the shaft 42 is fixed to the swing arm 41 and the rough adjustment cam 37 abuts against the cam follower 40 and is prevented from moving to the right in FIG. 1, the swing arm 41 is swung about the shaft 42 clockwise in FIG. 1 so that the guide members 5, 6 and the stacking blocks 8*a*, 8*b* are moved closer to each other. Since the lobe of the fine adjustment cam 36 has smaller unevenness than that of the rough adjustment cam 37, it is possible to adjust the spacing between the guide members 5, 6 and the spacing between the stacking blocks 8*a*, 8*b* to predetermined values by first rotating the rough adjustment cam 37, thereby moving the guide members 5, 6 and the stacking blocks 8***a*, 8*b* toward each other by a relatively great distance and then rotating the fine adjustment cam 36 for thereby moving the guide members 5, 6 and the stacking blocks 8*a*, 8*b* toward each other little by little. The reason why the guide members 5, 6 and the stacking blocks 8*a*, 8*b* are moved so that the ratio of their moving distances is always equal to $1:2^{1/2}$ will now be explained with reference to FIG. 7. Suppose that when the pair of stacking blocks 8*a*, 8*b* (only stacking block 8*b* shown) abut against each other, the temporarily stacked coin C1 is of a diameter slightly smaller than the distance r1 between the center of the coin temporary stacking section 7 and the first and second inner walls 8*a*-1, 8*b*-1, 8*a*-2, 8*b*-2 of the stacking blocks 8*a*, 8*b*, and that when they are apart from each other by a predetermined distance, the temporarily stacked coin is C2 of a diameter slightly smaller than the distance r2 between the center of the coin temporary stacking section 7 and the first and second inner walls 8*a*-1, 8*b*-1, 8*a*-2, 8*b*-2 of the stacking blocks 8*a*, 8*b*. It then follows that the width of the coin sorting passage 4 when the coins C2 are stacked is larger than that of the same when the coins C1 are stacked by 2×(r2−r1). Since the passage width adjusting mechanism adjusts the width of the coin sorting passage 4 by moving both of the guide members 5, 6 equally, the amount of movement Dr of each guide member 5, 6 is Dr=r2−r1. On the other hand, in order to guide the coin by four points on the first and second inner walls 8*a*-1, 8*b*-1, 8*a*-2, 8*b*-2 with a spacing of, for example, 1 mm from each inner wall 8*a*-1, 8*b*-1, 8*a*-2, 8*b*-2 regardless of the diameter of the stacked coins, the amount of movement Dw of each stacking block 8*a*, 8*b* has to be Dw=Dr/(cosX), wherein X is the angle between the first inner wall 8*a*-1 or 8*b*-1 and a line drawn parallel to the direction in which the coin sorting passage 4 extends, and is consequently the angle between a line lying perpendicular to the direction in which the coin sorting passage 4 extends and a line drawn from the center of the coin perpendicular to the first inner wall 8*a*-1 or 8*b*-1. In this embodiment, since the angle X is set at 45 degrees, Dw equals $2^{1/2}$xDr. Since the moving distance of the guide members 5, 6 corresponds to Dr and that of the stacking blocks 8*a*, 8*b* corresponds to Dw, the ratio of the moving distance of the guide members 5, 6 to that of the stacking blocks 8*a*, 8*b* is set to be $1:2^{1/2}$ at all times.

Figure 8A:
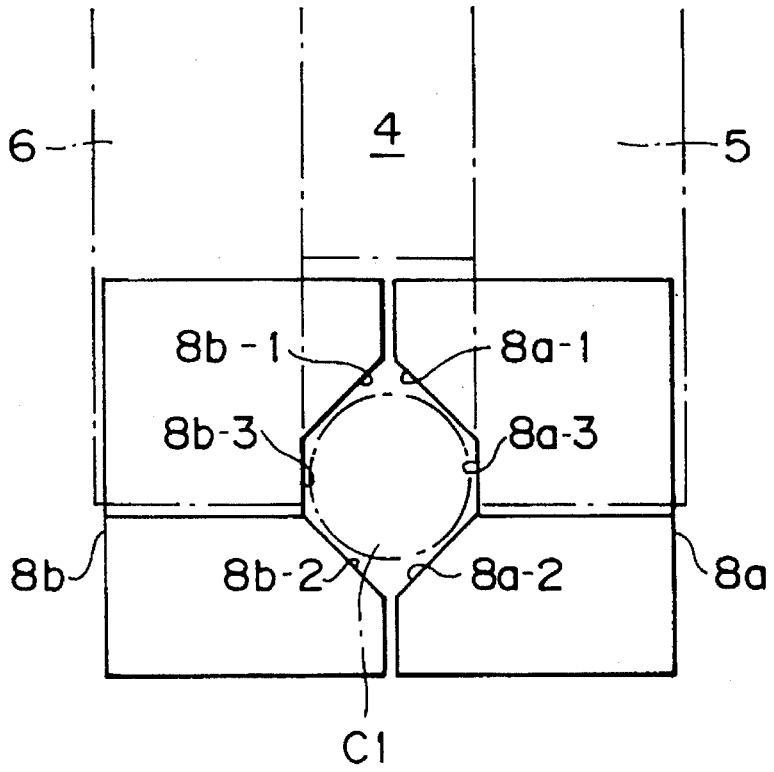
Figure 8B:
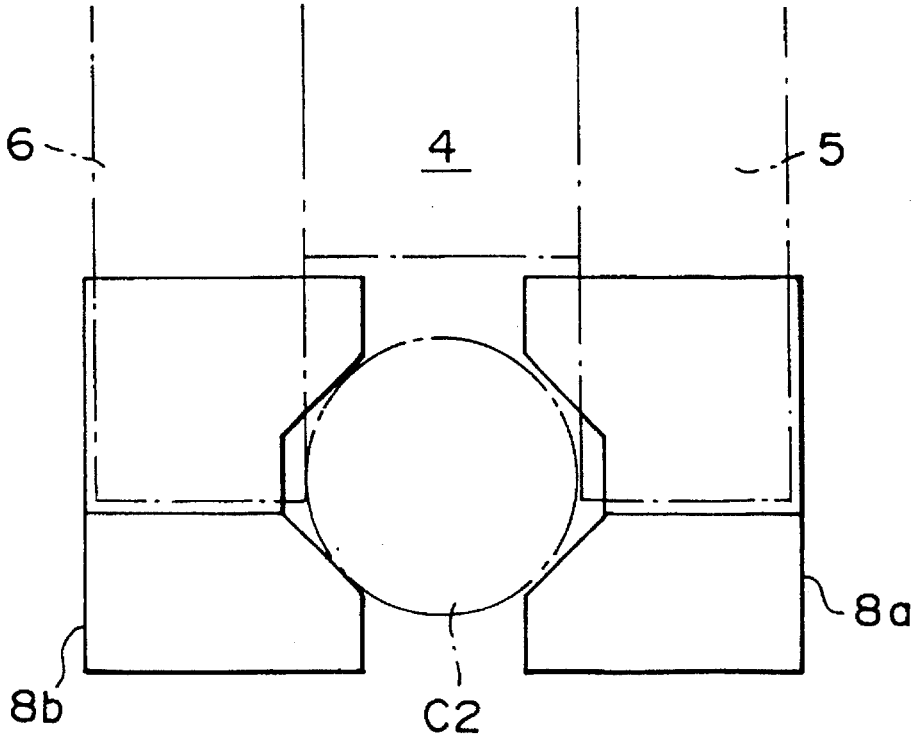

Consequently, by determining the ratio of L1 to L2 and that of L5 to L6 to be $1:2^{1/2}$, the ratio of the moving distance of the guide members 5, 6 to that of the stacking blocks 8*a*, 8*b* is set to be $1:2^{1/2}$ at all times, and therefore, as shown in FIG. 8A, when the stacking blocks 8*a*, 8*b* abut against each other, the temporarily stacked coins C1 can be guided by the four points on the first and second walls 8*a*-1, 8*b*-1, 8*a*-2, 8*b*-2, and, as shown in FIG. 8B, when the coin sorting passage 4 broadens, the temporarily stacked larger coins C2 can be surely guided by the four points thereon.

In this embodiment, the circumferences of the fine adjustment cam 36 and the rough adjustment cam 37 are each divided into sixteen sections. Thirteen of the sixteen sections of the fine adjustment cam 36 are used and the guide members 5, 6 are moved in increments of 0.1 min. Fifteen of the sixteen sections of the rough adjustment cam 37 are used and the guide members 5, 6 are moved in increments of 1.3 mm. It is therefore possible to move the guide members 5, 6 through 15×13=195 stages, namely, 15 mm to 34 mm.

The shutter 9 forming the bottom portion of the coin temporary stacking section 7 has a substantially rectangular lateral cross section and is supported by a shaft 63 fixed to the body of the coin wrapping machine at a point on its longitudinal axis in the vicinity of the edge portion on the side opposite from the coin temporary stacking section 7. An arm 65 of a shutter solenoid 64 is attached to the shutter 9 at a point offset from its longitudinal axis in the vicinity of the edge portion on the side opposite from the coin temporary stacking section 7. As a consequence, when the shutter solenoid 64 is driven, the shutter 9 is swung about the shaft 63 and is advanced to or retracted from the portion below the space between the stacking blocks 8*a*, 8*b*.

A sensor 66 for detecting coins is provided upstream of the coin temporary stacking section 7 in the coin sorting passage 4 and the detection signals thereof are input to a central processing unit; CPU (not shown).

A stopper 67 provided downstream of the sensor 66 is adapted to project into the coin sorting passage 4 for preventing coins from being fed to the coin temporary stacking section 7. The stopper 67 has a shape obtained by cutting a cylinder along its axis and removing the part on one side of the cut. It can be rotated by a stopper solenoid 68. The stopper 67 is constituted such that when it is positioned so that the cut side surface thereof faces the coin sorting passage 4, the side surface is flush with the side surface of the guide member 6 on the side of the coin sorting passage 4 and when the stopper 67 is rotated, the side surface of the cylinder projects into the coin sorting passage 4 to prevent coins from being transported further.

Figure 9:
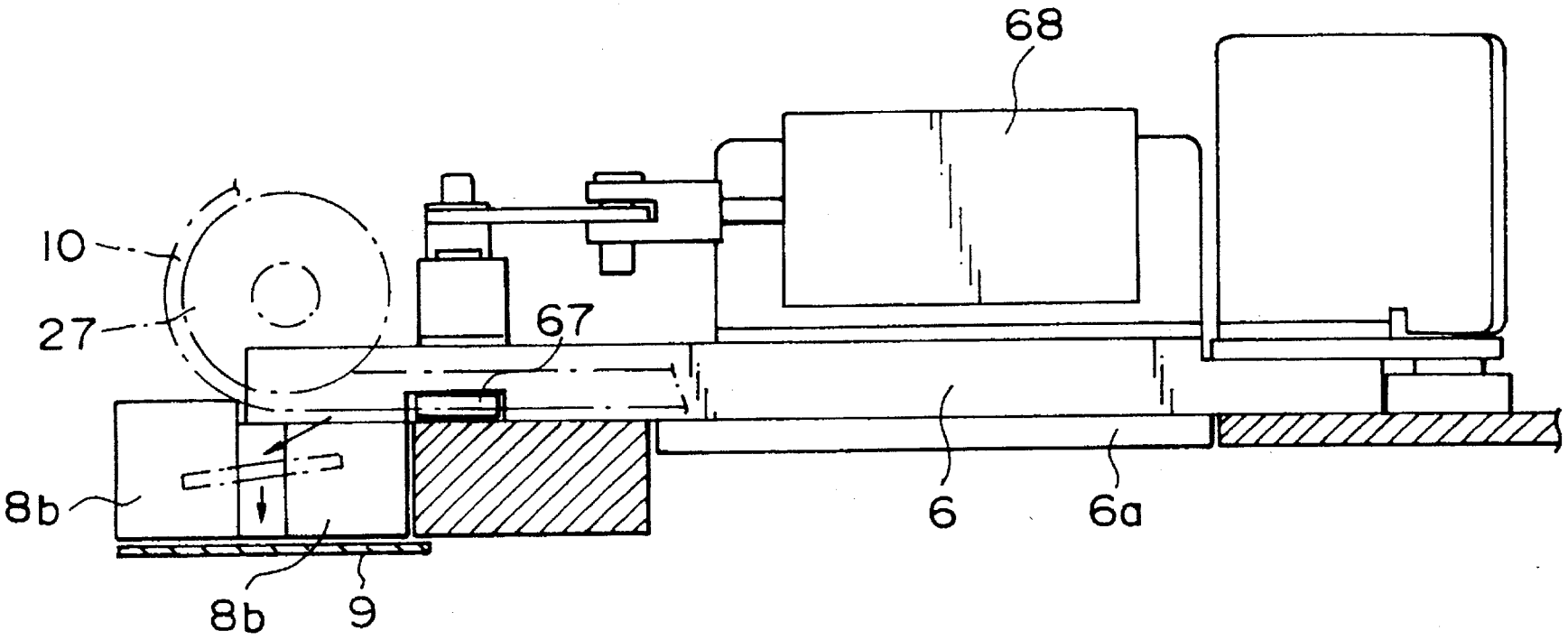
FIG. 9 is a schematic cross sectional view taken along line D—D in FIG. 1.

FIG. 9 is a schematic cross sectional view taken along line D—D in FIG. 1. As shown in FIG. 9, the stacking block 8*b* is formed such that its downstream portion is higher than its upstream portion. As the stacking block 8*a* is formed similarly, the coins fed from the coin sorting passage 4 collide with the second inner walls 8*a*-2, 8*b*-2 of the downstream portions of the stacking blocks 8*a*, 8*b* and arc stacked securely in the coin temporary stacking section 7.

Figure 10:
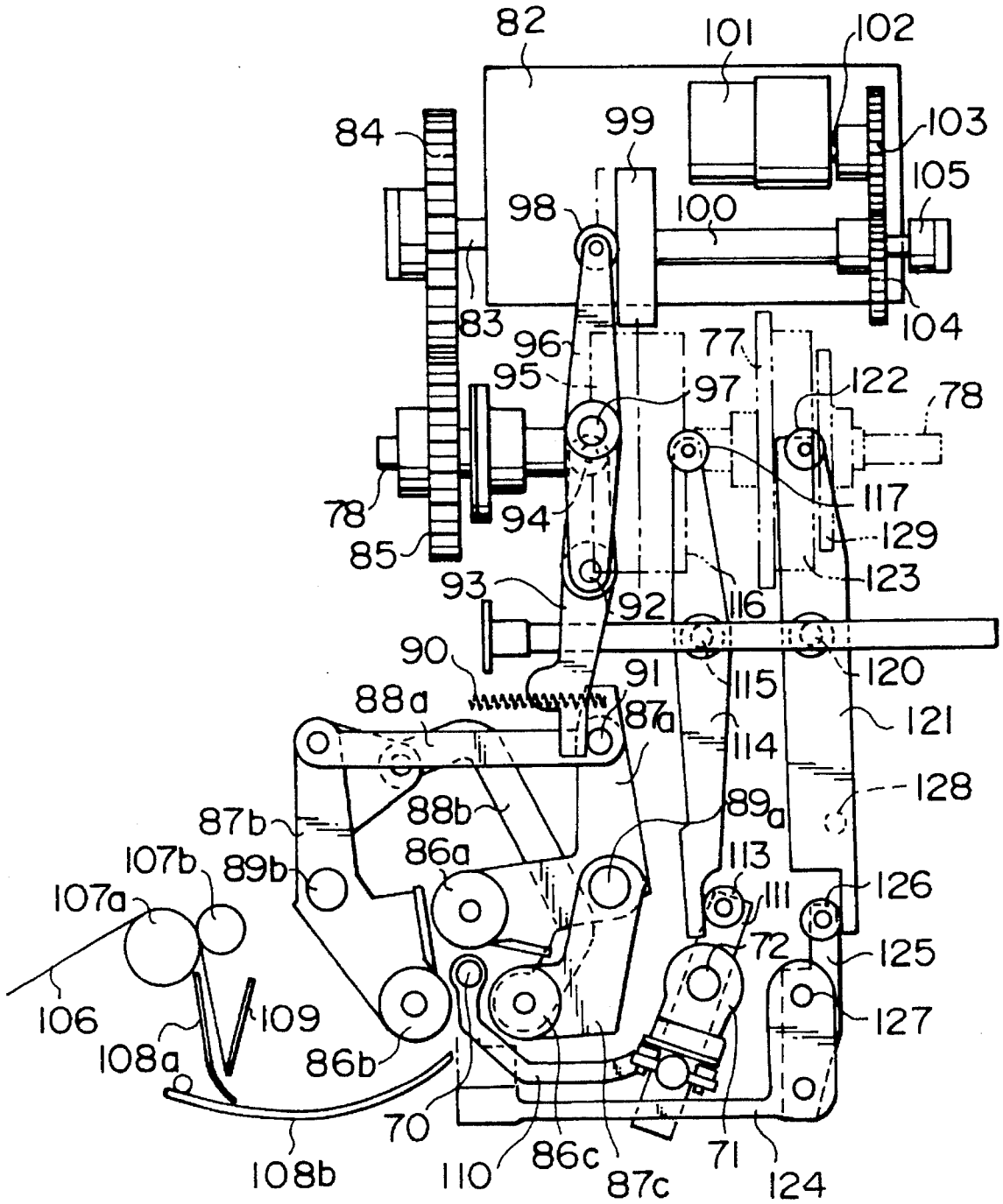
FIG. 10 is a schematic plan view showing a coin wrapping portion.

FIG. 10 is a schematic plan view of the coin wrapping section.

As shown in FIG. 10, the coin wrapping section includes a coin support post 70 for receiving coins from the coin temporary stacking section 7 and supporting them on the upper surface thereof. The coin support post 70 can be moved vertically by a post vertical moving mechanism (not shown in detail in FIG. 10) between a post waiting position immediately below the shutter 9 and a post wrapping position where coins are wrapped. More specifically, when a predetermined number of coins have been stacked in the coin temporary stacking section 7, the shutter 9 is driven to be opened, whereby the stacked coins are received by the upper surface of the coin support post 70 positioned immediately below the shutter 9. After the coin support post 70 has received a predetermined number of the stacked coins in this manner, it is thereafter lowered by a distance corresponding to the thickness of a single coin each time a new coin is fed to the coin temporary stacking section 7 and is stacked on the uppermost coin among the stacked coins supported on the coin support post 70. This lowering operation is conducted by the post vertical moving mechanism and a step motor described later. When a predetermined number of coins have been stacked on the upper surface of the coin support post 70, the coin support post 70 is lowered to the position where the coins are wrapped.

Figure 11:
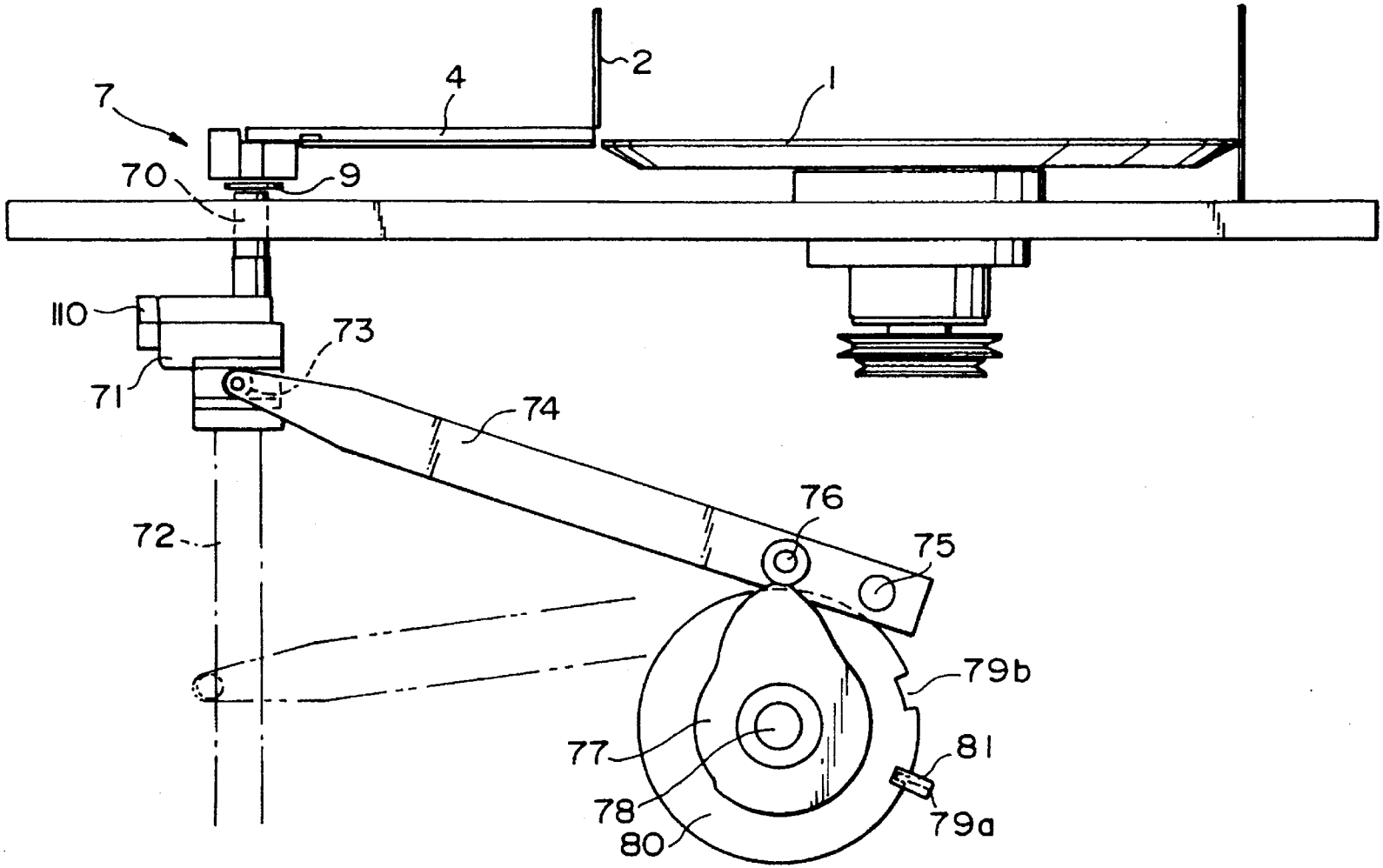
FIG. 11 is a schematic side view showing a post vertical moving mechanism.

FIG. 11 is a schematic side view of the coin vertical moving mechanism.

As shown in FIG. 11, the coin support post 70 is fixed to a post support block 71 via an arm 110 integrally formed therewith and the post support block 71 is supported by a support shaft 72 to be movable vertically. A roller 73 supported by one end portion of an arm 74 is inserted into a groove (not shown) formed in the post support block 71 and the other end portion of the arm 74 is mounted on a shaft 75 fixed to the body of the coin wrapping machine so as to be swingable about the shaft 75. A cam follower 76 is mounted on a portion of the arm 74 in the vicinity of the shaft 75 and abuts against the cam surface of a post elevating and lowering cam 77. The post elevating and lowering cam 77 is fixed to a cam shaft 78 and when the cam shaft 78 is rotated, the post elevating and lowering cam 77 is synchronously rotated, thereby moving the cam follower 76 in accordance with the lobe thereof. As a result, the arm 74 is swung about the shaft 75 and the post support block 71 is moved along the support shaft 72 vertically, whereby the coin support post 70 is moved vertically. A disk 80 whose periphery is formed with two cut portions 79*a*, 79*b* is fixed to the cam shaft 78. A photosensor 81 detects the smaller cut portion 79*a* when the coin support post 70 is positioned immediately below the shutter 9 and detects the larger cut portion 79*b* when the coin support post 70 is retracted from between three wrapping rollers (not shown) to a post retracted position, as described later.

As shown in FIG. 10, a gear 84 is fixed to the output shaft 83 of the step motor 82 and the cam shaft 78 is fixed to a gear 85 meshing with the gear 84.

In FIG. 10, the reference numerals 86*a*, 86*b*, 86*c* designate wrapping rollers which are mounted on one end portions of arms 87*a*, 87*b*, 87*c* respectively. Portions of the arms 87*a*, 87*b* in the vicinity of the other end portions thereof are connected to each other by a link 88*a* and a portion of the arm 87*c* in the vicinity of the wrapping roller 86*c* is connected to a portion of the arm 87*b* in the vicinity of the other end portion thereof by a link 88*b*. The other end portion of the arm 87*c* is connected to a curved portion of the arm 87*a*, which is shaped like a reverse L. The arms 87*a*, 87*c* are swingable about a shaft 89*a* and the arm 87*b* is swingable about a shaft 89*b*. A tension spring 90 is mounted on the other end portion of the arm 87*a* to bias the other end portion of the arm 87*a* to the left in FIG. 10. Further, a pin 91 is secured to a connected portion of the arm 87*a* and the link 88*a* and abuts against one end portion of an arm 93 fixed to a movable shaft 92. A cam follower 94 is mounted on the other end portion of the arm 93 and abuts against a first wrapping roller position adjusting cam 95 for moving the wrapping rollers 86*a*, 86*b*, 86*c* from wrapping roller waiting positions determined in accordance with the denomination of the coins to be wrapped to wrapping roller wrapping positions where the wrapping rollers 86*a*, 86*b*, 86*c* are moved close to each other to hold coins therebetween for wrapping them. The movable shaft 92 is inserted into one end portion of an arm 96 disposed above the arm 93. The arm 96 is mounted on a support shaft 97 so as to be swingable thereabout at substantially its central portion and a cam follower 98 is mounted on the other end portion of the arm 96. The first wrapping roller position adjusting cam 95 is fixed to the cam shaft 78.

The cam follower 98 abuts against the cam surface of a second wrapping roller position adjusting cam 99 for moving the wrapping rollers 86*a*, 86*b*, 86*c* to the wrapping roller waiting positions determined in accordance with the denomination of the coins to be wrapped when the wrapping mode is selected and to wrapping roller retracted positions which are predetermined irrespective of the denominations of coins to be counted and where the wrapping rollers 86*a*, 86*b*, 86*c* arc further apart when the counting mode is selected. The second wrapping roller position adjusting cam 99 is fixed to a cam shaft 100. A gear 104 meshing with a gear 103 fixed to the output shaft 102 of a motor 101 is fixed to the cam shaft 100. In FIG. 10, the reference numeral 105 designates a rotary switch for detecting the spacing between the wrapping rollers 86*a*, 86*b*, 86*c*.

Figure 12:
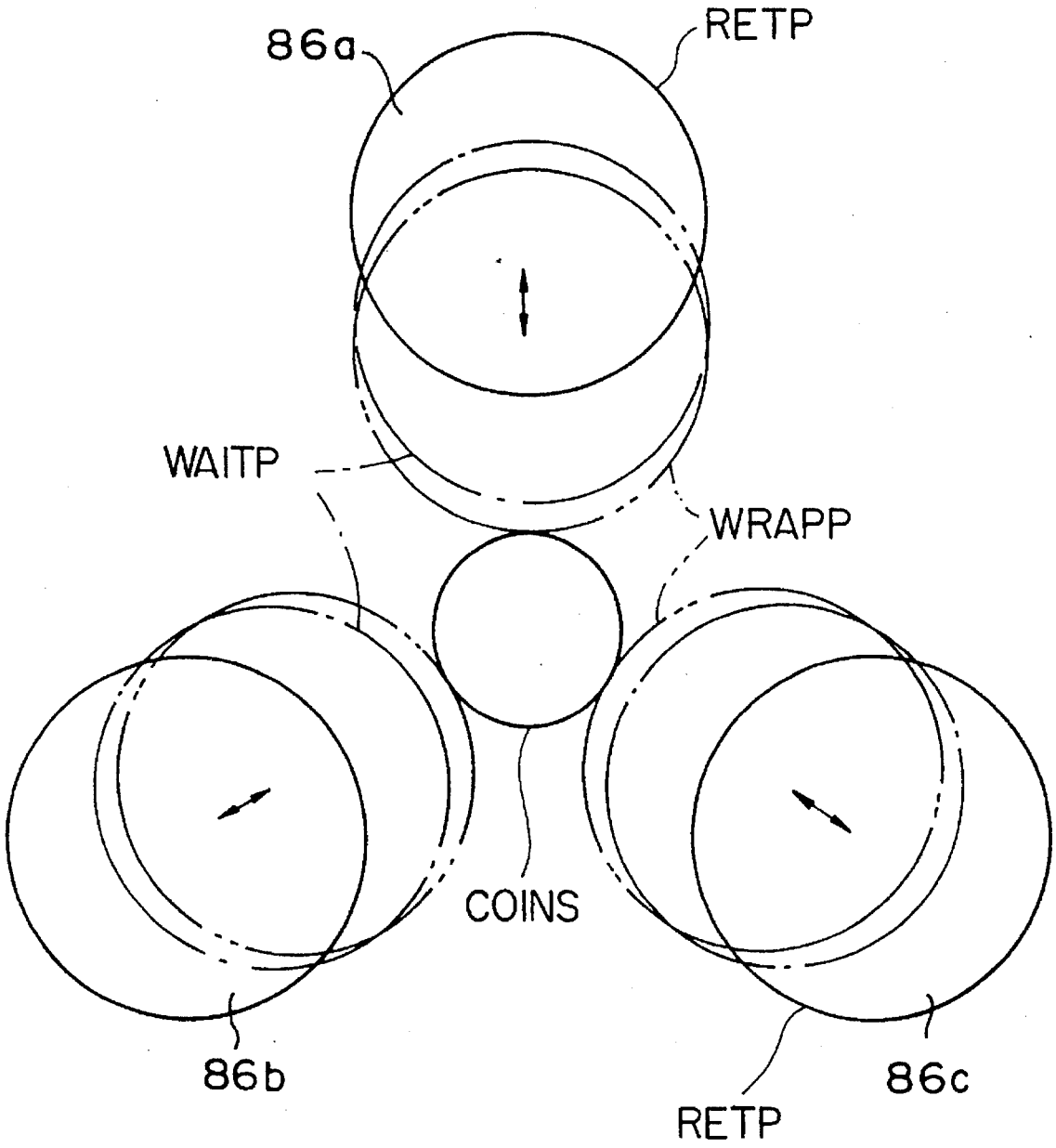
FIG. 12 is a schematic plan view showing the relationship between the wrapping roller wrapping positions, wrapping roller waiting positions and wrapping roller retracted positions of these wrapping rollers.

FIG. 12 is a schematic plan view showing the relationship between wrapping roller wrapping positions WRAPP, wrapping roller waiting positions WAITP and wrapping roller retracted positions RETP of the wrapping rollers 86*a*, 86*b*, 86*c*. In FIG. 12, the distance between the wrapping roller wrapping positions WRAPP and the wrapping roller waiting positions WAITP is constant irrespective of the denomination of the coins to be wrapped. Therefore, the first wrapping roller position adjusting cam 95 is adapted for always moving the wrapping rollers 86*a*, 86*b*, 86*c* toward or away from each other by the distance between the wrapping roller wrapping positions WRAPP and the wrapping roller waiting positions WAITP irrespective of the denominations of the coins to be wrapped. Further, the wrapping roller retracted positions REPT are fixed irrespective of the denominations of coins. However, the wrapping roller waiting positions WAITP are determined in accordance with the coin denominations, namely, the coin diameter. As a consequence, the second wrapping roller position adjusting cam 99 is adapted for moving the wrapping rollers 86*a*, 86*b*, 86*c* toward or away from each other by the distance between the wrapping roller retracted positions RETP and the wrapping roller waiting positions WAITP determined in accordance with the denomination of the coins to be wrapped. Thus, since the wrapping roller waiting positions WAITP differ in accordance with the denominations of the coins to be wrapped, the wrapping roller wrapping positions WRAPP necessarily differ in accordance with the denominations of the coins to be wrapped.

When coins are wrapped, the wrapping rollers 86*a*, 86*b*, 86*c*, which have been located at the wrapping roller waiting positions WAITP determined in accordance with the denomination of the coins wrapped in the previous wrapping operation, are first moved to the wrapping roller waiting positions WAITP determined in accordance with the denomination of the coins to be wrapped in the present wrapping operation. More specifically, the motor 101 is driven and the wrapping rollers 86*a*, 86*b*, 86*c* are moved toward or away from each other so that the spacing between the wrapping rollers 86*a*, 86*b*, 86*c* is greater than the diameter of the coins to be wrapped by a small predetermined distance, whereby they are moved to the wrapping roller waiting positions WAITP. For instance, in the case where the diameter of the coins to be wrapped in the present wrapping operation is greater than that of the coins wrapped in the previous wrapping operation, the motor 101 rotates the gear 103 and the gear 104 via the output shaft 102 thereby rotating the cam shaft 100 and the second wrapping roller position adjusting cam 99. As a result, the cam follower 98 moves to the left in FIG. 10 in accordance with the lobe of the second wrapping roller position adjusting cam 99 and the arm 96 is swung about the support shaft 97 counterclockwise in FIG. 10. Therefore, the movable shaft 92 is moved to the right in FIG. 10 and the arm 93 fixed to the movable shaft 92 moves the pin 91 to the right in FIG. 10 against the force of the tension spring 90. Consequently, the arm 87*a* is swung about the support shah 89*a* clockwise in FIG. 10 whereby the arm 87*b* is swung clockwise in FIG. 10 via the link 88*a* and the arm 87*c* is swung counterclockwise in FIG. 10 via the link 88*a* and the link 88*b* so that the wrapping rollers 86*a*, 86*b*, 86*c* are moved apart from each other and to the wrapping roller waiting positions WAITP of the denomination of the coins to be wrapped. On the contrary, in the case where the diameter of the coins to be wrapped in the present wrapping operation is smaller than that of the coins wrapped in the previous wrapping operation, the cam follower 98 moves to the right in FIG. 10 and the arm 96 is swung about the support shah 97 clockwise in FIG. 10, whereby the wrapping rollers 86*a*, 86*b*, 86*c* are moved closer to each other and to the wrapping roller waiting positions WAITP of the denomination of the coins to be wrapped.

On the other hand, since the first wrapping roller position adjusting cam 95 for moving the wrapping rollers 86*a*, 86*b*, 86*c* from the wrapping roller waiting positions WAITP to the wrapping roller wrapping positions WRAPP so as to be close to each other is fixed to the cam shaft 78, it is rotated synchronously with the vertical movement of the coin support post 70. More specifically, after the shutter 9 has been opened and the coin support post 70 has received a predetermined number of stacked coins on the upper surface thereof, the step motor 82 is driven and the cam shaft 78 is rotated via the output shaft 83, the gear 84 and the gear 85 so that the coin support post 70 is lowered by the thickness of one coin each time one coin is fed into the coin temporary stacking section 7 and stacked onto the uppermost coin among the stacked coins supported by the coin support post 70. The profile at the portion of the first wrapping roller position adjusting cam 95 corresponding to this period does not vary but is flat so that the wrapping rollers 86*a*, 86*b*, 86*c* are held at the wrapping roller waiting positions WAITP. The lobe of the first wrapping roller position adjusting cam 95 is determined so that when the coin support post 70 has supported the stacked coin in the number to be wrapped in one wrapped coin roll and has been lowered to the post wrapping position, the wrapping rollers 86*a*, 86*b*, 86*c* arc moved to the wrapping roller wrapping position WRAPP where the stacked coins supported by the coin support post 70 can be wrapped. More specifically, the first wrapping roller position adjusting cam 95 is rotated and the cam follower 94 abutting thereagainst at the end portion of the arm 93 is moved to the right in FIG. 10 in accordance with the lobe of the first wrapping roller position adjusting cam 95, whereby the arm 93 is swung about the movable shaft 92 clockwisc in FIG. 10. Accordingly, the arm 87*a* biased to the left in FIG. 10 by the tension spring 90 is swung about the support shaft 89*a* counterclockwise in FIG. 10, whereby the arm 87*b* is swung about the support shaft 89*b* counterclockwise in FIG. 10 via the link 88*a*, and the arm 87*c* is swung about the support shaft 89*a* clockwise in FIG. 10 via the link 88*a* and the link 88*b* so that the wrapping rollers 86*a*, 88*b*, 86*c* are moved toward each other. On the contrary, when coins are counted, the motor 101 is driven so that the wrapping rollers 86*a*, 88*b*, 86*c* are moved apart from each other and are positioned at predetermined wrapping roller retracted positions RETP.

As shown in FIG. 10, a wrapping film feeding mechanism is provided for feeding a wrapping film 106 from a wrapping film roll (not shown) to between the wrapping rollers 86*a*, 88*b*, 86*c*. The wrapping film feeding mechanism includes a pair of film feeding rollers 107*a*, 107*b* for holding the wrapping film 106 therebetween and feeding it, guides 108*a*, 108*b* for guiding the wrapping film 106 along a desired path and a cutter 109 for cutting the wrapping film 106 when a predetermined length of the wrapping film 106 has been fed to between the wrapping rollers 86*a*, 86*b*, 86*c*.

The coin support post 70 is formed integrally with an arm 110 and the arm 110 is fixed to the post support block 71. An arm 111 is fixed to the post support block 71 to be swingable about the support shaft 72 and is always biased counterclockwise in FIG. 10 by a spring (not shown). A roller 113 rotatably mounted on one end portion of the arm 111 abuts against a post retracting arm 114 for retracting the coin support post 70 from between the wrapping rollers 86*a*, 88*b*, 86*c* so that wrapped coins or counted coins can fall between the wrapping rollers 86*a*, 88*b*, 86*c* and be collected after the coin wrapping has been completed or when only the coin counting is effected. The post retracting arm 114 is swingable about a shaft 115 fixed to the body of the coin wrapping machine and a cam follower 117 abutting against the cam surface of a post retracting cam 116 fixed to the cam shaft 78 is rotatably mounted on an end portion of the post retracting arm 114 opposite to the roller 113.

Further, a crimp claw retracting mechanism is provided for retracting a pair of upper and lower crimp claws (not shown) adapted to crimp the upper and lower end portions of the wrapping film 106 which has been wound around the coins to be wrapped from a crimping position where the wrapping film is crimped to crimp claw retracted positions. The crimp claw retracting mechanism includes a crimp claw retracting arm 121 swingable about a shaft 120 fixed to the body of the coin wrapping machine and a cam follower 122 is rotatably mounted on one end portion of the crimp claw retracting arm 121. The cam follower 122 abuts against the cam surface of a crimp claw retracting cam 123 fixed to the cam shaft 78. The other end portion of the crimp claw retracting arm 121 is integrally formed with the crimp claws and abuts against a roller 126 rotatably mounted on one end portion of an arm 125 fixed to an arm 124 extending from the crimp claws. The arm 124 and the arm 125 are swingable about a support shaft 127 and are biased counterclockwise in FIG. 10 about the shaft 127 by a spring (not shown). In FIG. 10, the reference numeral 128 designates a crimp claw actuating stopper for holding the crimp claws at their crimp claw retracted positions when, for instance, the stacked coins arc discharged without being wrapped. A crimp claw actuating cam 129 is fixed to the cam shah 78 for moving the crimp claws vertically and causing them to crimp the upper and lower end portions of the wrapping film 106 wound around the stacked coins. A known mechanism is used as the crimping mechanism for moving the crimp claws and causing them to crimp the upper and lower end portions of the wrapping film 106 and a known mechanism is used as the mechanism for rotating the wrapping rollers 86*a*, 86*b*, 86*c*. Therefore, the description of these mechanism is omitted.

FIG. 13A to 13E are a cam chart of the post elevating and lowering cam 77, the first wrapping roller position adjusting cam 95, the post retracting cam 116 and the crimp claw retracting cam 123 during one cam shaft rotation.

In FIG. 10, when the long cut portion 79*b* has been detected by the photosensor 81, which is when the coin wrapping has been completed and when only the coin counting is to be effected, the concave cam surface of the post elevating and lowering cam 77 abuts against the cam follower 76 and the convex cam surface of the post retracting cam 116 abuts against the cam follower 117. Further, the convex cam surface of the first wrapping roller position adjusting cam 95 abuts against the cam follower 94 and the convex cam surface of the crimp claw retracting cam 123 abuts against the cam follower 122. Accordingly, since the coin support post 70 and the post support block 71 are located at their lower positions and the post retracting arm 114 has been swung clockwise about the shaft 115, the coin support post 70 is located at the post retracted position where the coin support post is retracted from the space between the wrapping rollers 86*a*, 86*b*, 86*c*. On the other hand, since the arm 93 has been swung counterclockwise about the movable shaft 92, as described above, the spacing between the wrapping rollers 86*a*, 86*b*, 86*c* is great and the wrapping rollers 86*a*, 86*b*, 86*c* are located at the wrapping roller waiting positions. Further, since the crimp claw retracting arm 121 has been swung clockwise about the support shaft 120, the arm 124 integrally formed with the crimp claws has been swung counterclockwise about the support shaft 127 and the crimp claws are located at the crimp claw retracted position.

Figure 13:
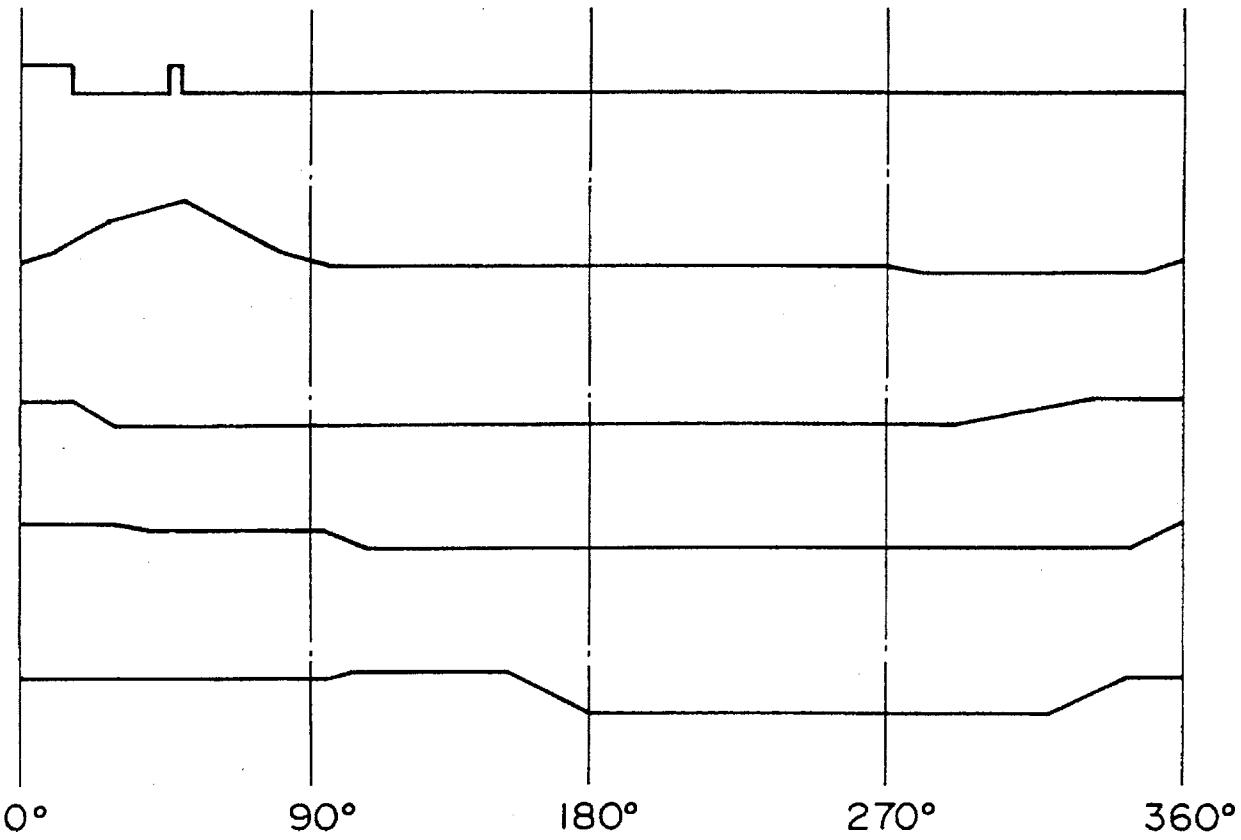
FIGS. 13A to 13E arc a cam chart of a post elevating and lowering cam, a first wrapping roller position adjusting cam, a post retracting cam and a crimp claw retracting cam during one rotation of a cam shaft.

As shown in FIG. 13, as the cam shaft 78 is rotated, the portion of the cam profile of the post elevating and lowering cam 77 against which the cam follower 76 abuts becomes convex. Consequently, the coin support post 70 and the post support block 71 are gradually elevated. When the cam shaft 78 has been rotated by 45 degrees and the photosensor 81 has detected the small cut portion 79*a* of the disk 80, the cam follower 76 has come to abutment against the most convex portion of the post elevating and lowering cam 77 and the coin support post 70 and the post support block 71 have been elevated to their uppermost positions. On the other hand, as the cam shaft 78 is further rotated, the portion of the cam profile of the post retracting cam 116 against which the cam follower 117 abuts becomes gradually concave. Consequently, the post retracting arm 114 is swung counterclockwise about the shaft 115 and the coin support post 70 is moved into the space between the wrapping rollers 86*a*, 86*b*, 86*c*. Therefore, when the photosensor 81 detects the small cut portion 79*a* of the disk 80, the coin support post 70 is located at the post waiting position immediately below the shutter 9 in the central portion of the space between the wrapping rollers 86*a*, 86*b*, 86*c*. When the predetermined number of coins have been stacked in the coin temporary stacking section 7 in this state, the shutter solenoid 64 is driven and the shutter 9 is opened, whereby the coins stacked in the coin temporary stacking section 7 are received by the upper surface of the coin support post 70 standing by immediately below the shutter 9.

As the cam shaft 78 is further rotated, the portion of the cam profile of the post elevating and lowering cam 77 against which the cam follower 76 abuts gradually becomes concave so that the coin support post 70 is lowered with the stacked coins supported on the upper surface thereof. On the contrary, the portion of the cam profile of the post retracting cam 116 against which the cam follower 117 abuts becomes flat when the cam shaft 78 has been rotated by about 30 degrees, whereby the coin support post 70 is lowered in the space between the three wrapping rollers 86*a*, 86*b*, 86*c*. The cam shaft 78 is intermittently rotated by the step motor 82 and is controlled so that the coin support post 70 is intermittently lowered in increments equal to the thickness of one coin to be wrapped. When the cam shaft 78 has been rotated by about 100 degrees, the coin support post 70 has reached the post wrapping position where the stacked coins can be wrapped with the predetermined number of the stacked coins supported on the upper surface thereof. Then, the portion of the cam profile of the post elevating and lowering cam 77 against which the cam follower 76 abuts becomes uniform and the coin support post 70 is held at the post wrapping position until the cam shaft has been rotated by about 270 degrees.

On the other hand, the portion of the cam profile of the first wrapping roller position adjusting cam 95 against which the cam follower 94 abuts is uniform during the time that the coin support post 70 is moved from the post waiting position immediately below the shutter 9 to the post wrapping position as the cam shaft 78 is rotated. As a consequence the wrapping rollers 86*a*, 86*b*, 86*c* are held at the wrapping roller wrapping positions WRAPP. After the coin support post 70 supporting the predetermined number of the stacked coins on the upper surface thereof has reached the post wrapping position, and the cam shaft 78 has been rotated by about 110 degrees, the three wrapping roller 86*a*, 86*b*, 86*c* are moved from the wrapping roller waiting positions WAITP to the wrapping roller wrapping positions WRAPP where the wrapping rollers 86*a*, 86*b*, 86*c* are closest to each other and the stacked coins can be wrapped and held therebetween. Although the traveling distance of the wrapping rollers 86*a*, 86*b*, 86*c* caused by the first wrapping roller position adjusting cam 95 is constant, since the wrapping rollers 86*a*, 86*b*, 86*c* are located by the second wrapping roller position adjusting cam 99 so as to be spaced from each other by predetermined spacings in accordance with the denomination of the coins to be wrapped before the cam shaft 78 begins to be rotated, it is possible for the first wrapping roller position adjusting cam 95 to locate the wrapping rollers 86*a*, 86*b*, 86*c* at the wrapping roller wrapping positions WRAPP where the coins stacked on the upper surface of the coin support post 70 can be wrapped. Immediately before the wrapping rollers 86*a*, 86*b*, 86*c* are moved from the wrapping roller waiting positions WAITP to the wrapping roller wrapping positions WAITP, the wrapping film 106 is fed by the film feeding rollers 107*a*, 107*b* front a wrapping film roll (not shown) to between the stacked coins supported on the upper surface of the coin support post 70 and the wrapping rollers 86*a*, 86*b*, 86*c* and is held together with the stacked coins between the wrapping rollers 86*a*, 86*b*, 86*c*, whereby the stacked coins are wrapped.

On the contrary, the portion of the cam profile of the crimp claw retracting cam 123 against which the cam follower 122 abuts does not substantially change until the cam shaft 78 has been rotated by about 155 degrees and, therefore, the crimp claws are not substantially moved at the crimp claw retracted position. However, after the cain shaft 78 has been rotated by about 155 degrees, the portion of the cam profile of the crimp claw retracting cam 123 against which the cam follower 122 abuts gradually becomes concave and the crimp claw retracting arm 121 is swung counterclockwise about the support shaft 120. As a result, the arm 124 integrally formed with the crimp claws is swung about the support shaft 127, whereby the pair of crimp claws are moved to abovc and below the stacked coins around which the wrapping film 106 has been wound. Then, the crimp claw actuating cam 129 is rotated and the upper and lower end portions of the wrapping film 106 wound around the stacked coins are crimped.

When the wrapping and the crimping of the wrapping film 106 have been completed and the cam shaft 78 has been rotated by about 270 degrees, the portion of the cam profile of the post elevating and lowering cam 77 against which the cam follower 76 abuts becomes concave again and the coin support post 70 is further lowered from the post wrapping position. When the cam shaft 78 has been rotated by about 290 degrees, the portion of the cam profile of the post retracting cam 116 against which the cam follower 117 abuts gradually becomes convex and, as a result, the coin support post 70 is moved from the space between the wrapping rollers 86*a*, 86*b*, 86*c* to the post retracted position.

When the cam shaft 78 has been rotated by about 320 degrees, the portion of the cam profile of the crimp claw retracting cam 123 against which the cam follower 122 abuts gradually becomes convex and the crimp claws are moved to the crimp claw retracted positions.

When the cam shaft 78 has been rotated by about 340 degrees, the portion of the cam profile of the first wrapping roller position adjusting cam 95 against which the cam follower 94 abuts gradually becomes convex and the wrapping rollers 86*a*, 86*b*, 86*c* are moved from the wrapping roller wrapping positions WRAPP to the wrapping roller waiting positions WAITP.

Thus, one cycle of the wrapping operation is completed.

Figure 14:
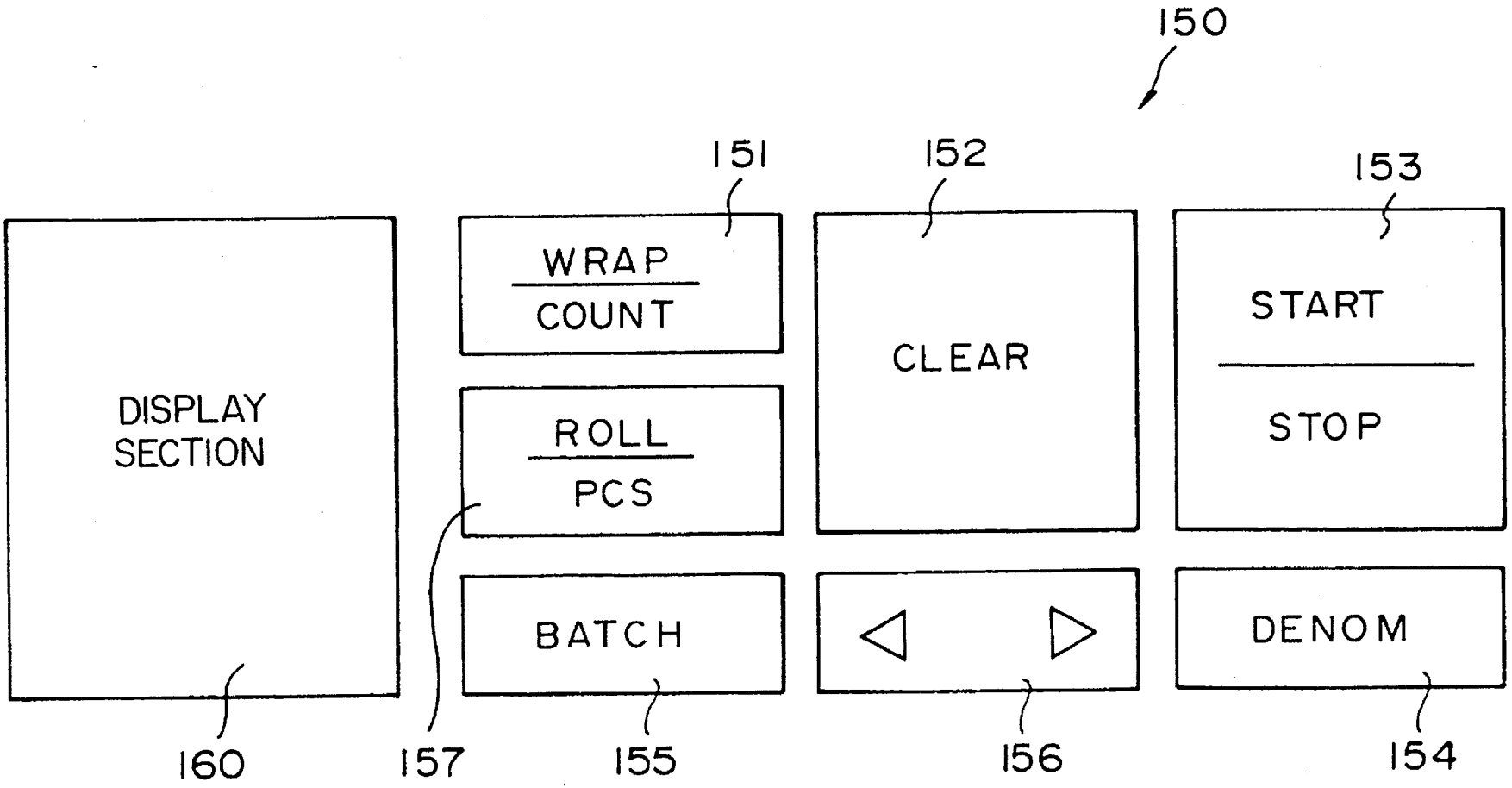
FIG. 14 is a schematic plan view showing an operating section and a display section provided on an outer surface of a coin wrapping machine.
Figure 15:
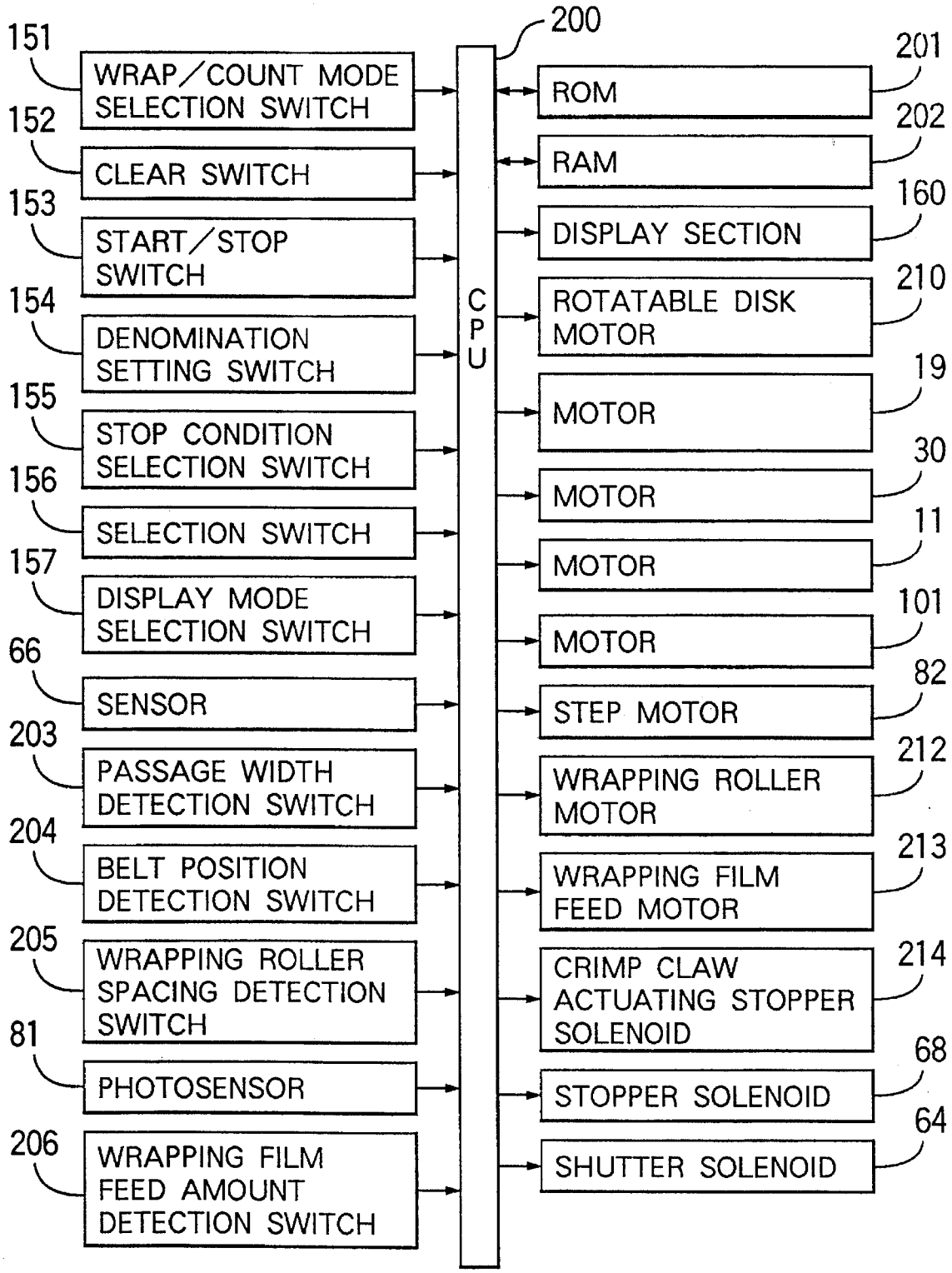
FIG. 15 is a block diagram of a control system, a storage system, a driving system, a detection system and an operation system of a coin wrapping machine which is an embodiment of the present invention.

FIG. 14 is a schematic plan view showing an operating section and a display section provided on an outer surface of the thus constituted coin wrapping machine which is an embodiment of the present invention and FIG. 15 is a block diagram of a control system, a storage system, a driving system, a detection system and an operation system of the coin wrapping machine.

As shown in FIG. 14, the operating section 150 provided on an outer surface of the coin wrapping machine which is an embodiment of the present invention includes a wrap/count mode selection switch (WRAP/COUNT) 151 for selecting whether the coin wrapping machine should be operated to wrap or count coins, a clear switch (CLEAR) 152 for causing the coin wrapping machine to cffcct a preparatory operation prior to wrapping or counting coins, a start/stop switch (START/STOP) 153 for actuating or stopping the coin wrapping machine, a denomination setting switch (DENOM) 154 operated in the case where the denomination of the coins to be wrapped or counted is set, a stop condition selection switch (BATCH) 155 operated for selecting, when coins arc to be wrapped, whether the coins should be wrapped and the coin wrapping operation should not be stopped until the number of the wrapped coin rolls including a predetermined number of coins has become equal to the specified number or until the total number of wrapped coins has become equal to the specified number, or selecting, when coins arc to be counted, whether coins should be counted and the counting operation should not be stopped until the number of the counted coins has become equal to the specified number or until all deposited coins have been counted, a selection switch 156 for selecting the denomination or the condition for stopping the coin wrapping machine when the denomination setting switch 154 was operated or the stop condition selection switch 155 was operated, and a display mode selection switch 157 for causing a display section 160 to display the number of the wrapped coin rolls of coins or the number of the wrapped coins.

More specifically, the coin wrapping and counting operation and the coin counting operation arc alternately selected each time the wrap/count mode selection switch (WRAP/COUNT) 151 is operated.

Similarly, the coin wrapping and counting operation or the coin counting operation is started or the coin wrapping and counting operation or the coin counting operation is stopped each time the start/stop switch 153 is operated.

Further, if the denomination setting switch 154 is operated, the denominations which can be selected are displayed on the display section 160 and it becomes possible to arbitrarily set the denomination of the coins to be wrapped and counted or to be counted by operating the selection switch 156. If the stop condition selection switch 155 is operated, it becomes possible by operating the selection switch 156 to specify the number of wrapped coin rolls or the number of coins to be wrapped when the coin wrapping and counting operation is to be effected, or to specify the number of coins after which the coin counting operation should be stopped when only the coin counting operation is to be effected.

The display section 160 is constituted so as to display information on, for example, whether coin wrapping is being effected or whether coin counting is being effected, the denomination of the coins to be wrapped or counted which was specified by the operator, the number of coin rolls to be wrapped or the total number of coins, the number of wrapped coin rolls which have been produced or the total number of coins which have been wrapped, warnings for notifying the operator that some trouble has occurred, or the like.

As shown in FIG. 15, the control, storage, driving, detection and operation systems of the coin wrapping machine which is an embodiment of the present invention use a CPU 200 as a control means. The CPU can access a ROM (read-only memory) 201 for storing various data such as an operation program for the coin wrapping machine, coin data concerning the diameter and thickness of each denomination of coins and the like, a reference number M0 of coins to be stacked in the coin temporary stacking section 7, a reference wrapping unit number W0, the wrapping roller retracted positions where the wrapping rollers 86*a*, 86*b*, 86*c* should be located when coins are to be counted, the wrapping roller waiting positions where the wrapping rollers 86*a*, 86*b*, 86*c* should be located in accordance with the denomination of the coins to be wrapped prior to starting the wrapping of coins, the number of pulses that have to be output to the step motor 82 in order to lower the coin support post 70 by the thickness of one coin for each denomination, and a RAM (random access memory) 202 for storing the denomination of coins to be counted or wrapped, the number of coins detected by the sensor 66, information on whether or not the shutter 9 is open, the number and/or the total thickness of the coins stacked in the coin temporary stacking section 7, and the like.

The CPU 200 is constituted so as to receive operation signals from the wrap/count mode selection switch 151, the clear switch 152, the start/stop switch 153, the denomination setting switch 154, the stop condition selection switch 155, the selection switch 156 and the display mode selection switch 157 and to output a display signal to the display section 160 for causing it to display predetermined information.

Further, the CPU 200 receives a passage width detection signal from a passage width detection switch 203 comprising the rotary encoders 60, 61 for detecting the width of the coin sorting passage 4, namely, the spacing between the pair of guide members 5, 6, a belt position detection signal from a belt position detection switch 204 comprising the rotary encoder 22 for detecting the position of the transporting belt 10, a wrapping roller spacing detection signal from a wrapping roller spacing detection switch 205 comprising the rotary switch 105 for detecting the spacing between the wrapping rollers 86*a*, 86*b*, 86*c*, a cam shaft rotation position detection signal from the photosensor 81 for detecting the rotation position of the cam shaft 78 by detecting the cut portions 79*a*, 79*b* of the disk 80, and a wrapping film feed amount detection signal from a wrapping film feed amount detection switch 206 for detecting the length of the wrapping film 106 fed.

Moreover, the CPU 200 is constituted so as to output drive signals or stop signals to a rotatable disk motor 210 for rotating the rotatable disk 1, the motor 19 for driving the transporting belt 10, the motor 30 for adjusting the width of the coin sorting passage 4, namely, the spacing between the guide members 5, 6, the motor 11 for adjusting the position of the transporting belt 10, the motor 101 for adjusting the spacing between the wrapping rollers 86*a*, 86*b*, 86*c*, the step motor 82 for rotating the cam shaft 78, a wrapping roller motor 212 for rotating the wrapping rollers 86*a*, 86*b*, 86*c*, a wrapping film feed motor 213 for rotating the wrapping film feed rollers 107*a*, 107*b*, and a crimp claw actuating stopper solenoid 214 for driving the crimp claw actuating stopper 128, to output a rotation signal or a reverse rotation signal to the stopper solenoid 68 for rotating the stopper 67, and to output an open signal or a close signal to the shutter solenoid 64 for opening or closing the shutter 9.

The thus constituted coin wrapping machine operates in the following manner in the case where only coin counting is effected.

When an electrical power source (not shown) is turned on, the number of coins detected by the sensor 66 and stored in the RAM 202 is displayed on the display section 160. This number is zero when the operation is first started.

The wrap/count mode selection switch 151 and the denomination setting switch 154 can be operated only when the number of coins detected by the sensor 66 and stored in the RAM 202 is zero and the wrap/count mode selection switch 151 is operated by the operator to switch from the wrapping mode to the counting mode, whereby counting is selected.

Then, the operator operates the clear switch 152. When the clear switch 152 is operated, the CPU 200 outputs drive signals to the rotatable disk motor 210 and the motor 19 and outputs a reverse rotation signal to the stopper solenoid 68, thereby reversely rotating the rotatable disk 1, reversely driving the transporting belt 10 for a predetermined time period and further rotating the stopper 67 so that the cut flat side surface thereof is flush with the inner surface of the guide member 6.

As a result, any coins remaining or jammed in the coin sorting passage 4 are returned onto the rotatable disk 1.

After a predetermined time period has passed, the CPU 200 outputs drive stop signals to the rotatable disk motor 210 and the motor 19 and outputs a rotation signal to the stopper solenoid 68 to close the coin sorting passage 4.

When the clear switch 152 is operated, in the case where the wrapping mode was selected and coin wrapping and counting were effected in the previous cycle, the CPU 200 simultaneously outputs an open signal to the shutter solenoid 64 and outputs drive signals to the step motor 82 for rotating the cam shaft 78, the motor 101 for adjusting the spacing between the wrapping rollers 86*a*, 86*b*, 86*c* and the crimp claw actuating stopper solenoid 214 for driving the crimp claw actuating stopper 128 and in the case where the counting mode was selected and coin counting was effected in the previous cycle, the CPU 200 does not output an open signal to the shutter solenoid 64 since the shutter 9 is already open.

In the case where coin wrapping and counting were effected in the previous cycle, the coin support post 70 is located at the post waiting position immediately below the shutter 9 and since the shutter 9 opens the space between the pair of stacking blocks 8*a*, 8*b*, any coins remaining in the coin temporary stacking section are transferred onto the upper surface of the coin support post 70 located at the post waiting position. Since the drive signal to the step motor 82 continues to be output until the photosensor 81 detects the large cut portion 79*b* of the disk 80, the coin support post 70 is lowered to the post wrapping position, whereby the coins transferred onto the upper surface of the coin support post 70 and/or remaining on the upper surface of the coin support post 70 are held between the wrapping rollers 86*a*, 86*b*, 86*c* located at the wrapping roller wrapping positions WRAPP. Then, the coin support post 70 is moved to the post retracted position where the coin support post 70 is retracted from the space between the wrapping rollers 86*a*, 86*b*, 86*c* and the wrapping rollers 86*a*, 86*b*, 86*c* are moved to the wrapping roller retracted positions RETP so that the spacing therebetween becomes great, whereby the coins held between the wrapping rollers 86*a*, 86*b*, 86*c* fall downward in the space between the three wrapping rollers 86*a*, 86*b*, 86*c*.

The drive signal to the motor 101 for adjusting the spacing between the wrapping rollers 86*a*, 86*b*, 86*c* is output until the wrapping roller spacing detection switch 205 detects that the wrapping rollers 86*a*, 86*b*, 86*c* have reached the wrapping roller retracted positions determined irrespective of the denomination of the coins to be counted such that the spacing between the wrapping rollers 86*a*, 86*b*, 86*c* is maximum.

On the other hand, the drive signal to the crimp claw actuating stopper 128 is output until the photosensor 81 detects the large cut portion 79*b* of the disk 80 and, therefore, the crimp claws (not shown), are held at the crimp claw retracted positions by the crimp claw actuating stopper 128 until the coin support post 70 is lowered from the post waiting position immediately below the shutter 9 to the post retracted position. Accordingly, if coins remain in the coin temporary stacking section 7 and/or on the upper surface of the coin support post 70 and, as a result, when the coin support post 70 is lowered from the post waiting position to the post retracted position while on the upper surface thereof supporting coins in a number which is less than the number of coins to be wrapped in a wrapped coin roll and the coins are held between the wrapping rollers 86*a*, 86*b*, 86*c*, the crimp claws are held at the crimp claw retracted positions irrespective of the rotation of the cam shaft 78. Therefore, the coins are prevented from being damaged by the crimp claws moved to the crimping positions and by the crimping operation and the coins held between the wrapping rollers 86*a*, 86*b*, 86*c* are prevented from being scattered by an undesirable force applied thereto.

The shutter solenoid 64 is kept open until the clear switch 152 has been operated, the coin counting has been completed, and the wrapping mode has been selected by operating the wrap/count mode selection switch 151.

On the contrary, when the counting mode was selected and coin counting was effected in the previous cycle, the coin support post 70 is located at the lower post retracted position, the three wrapping rollers 86*a*, 86*b*, 86*c* are located at the wrapping roller retracted positions RETP and the crimp claws are located at the crimp claw retracted positions. Therefore, even when the clear switch 152 is operated, the CPU 200 does not output an open signal to the shutter solenoid 64 and also does not output drive signals to the step motor 82 for rotating the cam shaft 78 and the crimp claw actuating stopper solenoid 214 for driving the crimp claw actuating stopper 128.

When the operator operates the denomination setting switch 154 and the selection switch 156 so as to select the denomination of coins to be counted, the CPU 200 reads out the diameter, thickness and other such data regarding the selected coins from the ROM 201.

Based upon the coin data, the CPU 200 further outputs drive signals to the motor 30 for adjusting the spacing between the guide members 5, 6 and to the motor 11 for adjusting the position of the transporting belt 10, thereby adjusting the spacing between the guide members 5, 6 and the position of the transporting belt 10. This adjustment is effected until the spacing between the guide members 5, 6 and the position of the transporting belt 10 determined based upon a passage width detection signal from the passage width detection switch 203 and a belt position detection signal from the belt position detection switch 204 coincide with a target spacing between the guide members 5, 6 and a target position of the transporting belt 10 corresponding to the diameter and the thickness of the coins of the denomination to be counted which arc read out from the ROM 201. When the width of the coin sorting passage 4, namely, the spacing between the guide members 5, 6 is adjusted by the motor 30, the spacing between the stacking blocks 8*a*, 8*b* is synchronously adjusted in accordance with the selected denomination of the coins.

When the preparatory operation has been completed in the foregoing manner, the stop condition selection switch 155 becomes operable and when the operator operates the stop condition selection switch 155 to specify the number N0 of coins by which the counting should be completed, the CPU 200 stores the number N0 in the RAM 202 and when the operator does not specify the number N0 of coins by which the counting should be completed, it stores an infinite number in the RAM 202.

When all preparatory operations have been completed, information indicating that coin counting can be effected is displayed on the display section 160 and the coin wrapping machine is ready for counting coins.

After the operator has deposited coins into a coin depositing section (not shown) and then operated the start/stop switch 153, the coin counting operation is started.

More specifically, when the start/stop switch 153 is operated and a start signal is input to the CPU 200, the CPU 200 outputs drive signals to the rotatable disk motor 210 and the motor 19 and outputs a reverse rotation signal to the stopper solenoid 68. As a result, the rotatable disk motor 210 and the motor 19 are forwardly driven and the stopper solenoid 68 rotates the stopper 67 so that the cut flat side surface thereof is flush with the inner surface of the guide member 6.

As a consequence, since the width of the coin sorting passage 4, namely, the spacing between the guide members 5, 6 has been adjusted so as to correspond to the diameter of the denomination of coins to be counted, the coins of the denomination to be counted and any smaller coins are fed from the rotatable disk 1 into the coin sorting passage 4, whereas coins having greater diameter than that of the coins of the denomination to be counted remain on the rotatable disk I and are not fed into the coin sorting passage 4.

On the other hand, the coins which have a smaller diameter than that of the coins of the denomination to be counted and have been fed into the coin sorting passage 4 fall downward between the guide members 5, 6 and arc collected in a small coin collecting box (not shown).

Thus, only the coins of the denomination to be counted pass along the coin sorting passage 4 and arc detected by the sensor 66. The sensor 66 outputs a coin detection signal each time it detects the coin and the CPU 200 increases the number stored in the RAM 202 by one each time it receives the coin detection signal from the sensor 66.

After the coins have passed by the sensor 66, they are fed into the coin temporary stacking section 7. Since each of the pair of stacking blocks 8*a*, 8*b* is formed such that the downstream portion thereof is higher than the upstream portion thereof, each coin fed along the coin sorting passage 4 is directed downward by collision with the second inner walls 8*a*-2, 8*b*-2 of the downstream portions of the stacking blocks 8*a*, 8*b*. Since the shutter 9 is open, the wrapping rollers 86*a*, 86*b*, 86*c* are located at the wrapping roller retracted positions RETP, and the coin support post 70 is located at the lower position and the post retracted position, the coin fed into the coin temporary stacking section 7 falls between the wrapping rollers 86*a*, 86*b*, 86*c* and is collected in a designated denomination coin collecting box (not shown).

On the other hand, when the operator operates the stop condition selection switch 155 to specify the number N0 of coins by which the counting should be completed, the CPU 200 judges whether or not the number stored in the RAM 202 coincides with the specified number N0.

As a result, when the number stored in the RAM 202 is smaller than the specified number N0, coin counting is continued and the coins fall between the wrapping rollers 86*a*, 86*b*, 86*c* via the coin sorting passage 4 and the coin temporary stacking section 7 and are collected in the designated denomination coin collecting box.

On the contrary, when the CPU 200 judges that the number stored in the RAM 202 has become equal to the specified number N0, it outputs drive stop signals to the rotatable disk motor 210 and the motor 19 and outputs a rotation signal to the stopper solenoid 68, thereby causing the stopper to close the coin sorting passage 4.

As a result, no coins are fed from the rotatable disk 1 into the coin sorting passage 4 and the stopper 67 prevents coins from being fed to downstream of the stopper 67, whereby coin counting is completed.

When coin counting has been completed in this manner, the CPU 200 displays the fact that counting of the specified number of coins has been completed on the display section 160.

On the other hand, if the operator does not operate the stop condition selection switch 155 and the number N0 of coins by which the counting should be completed is not specified, the coin counting is continued until all coins of the specified denomination fall between the wrapping rollers 86*a*, 86*b*, 86*c* via the coin sorting passage 4 and the coin temporary stacking section 7 and are collected in the set denomination coin collecting box and when no coin detection signal is input from the sensor 66 after a predetermined time period has passed since the last coin detection signal was input to the CPU 200 from the sensor 66, the CPU 200 outputs drive stop signals to the rotatable disk motor 210 and the motor 19 and outputs a rotation signal to the stopper solenoid 68, thereby causing the stopper 67 to close the coin sorting passage 4.

Further, the CPU 200 judges that the counting of coins of the specified denomination has been completed and outputs a display signal to the display section 160, thereby displaying the number of coins of the specified denomination detected by the sensor 66 and stored in the RAM 202 on the display section 160 and also displaying the fact that the coin counting has been completed.

After coin counting has been completed in the above described manner, the operator opens the lid of the coin wrapping machine and removes the coins having greater diameter than that of the specified denomination of coins and remaining on the rotatable disk 1.

On the contrary, when the number of coins stored in the RAM 202 is equal to zero at the time the electrical power source (not shown) is turned on and the operator operates the wrap/count selection switch 151 to select the wrapping mode, the coin wrapping machine wraps coins in the following manner.

Similarly to the case of coin counting, when the clear switch 152 is operated, the CPU 200 outputs drive signals to the rotatable disk motor 210 and the motor 19 and outputs a reverse rotation signal to the stopper solenoid 68, thereby reversely rotating the rotatable disk 1, reversely driving the transporting belt 10 and rotating the stopper 67 so that the cut flat side surface thereof is flush with the inner surface of the guide member 6.

As a result, any coins remaining or jammed in the coin sorting passage 4 are returned onto the rotatable disk 1.

After a predetermined time period, the CPU 200 outputs drive stop signals to the rotatable disk motor 210 and the motor 19 and outputs a rotation signal to the stopper solenoid 68, thereby causing the stopper 67 to close the coin sorting passage 4.

When the clear switch 152 is operated, the CPU 200 simultaneously outputs drive signals to the step motor 82 for rotating the cam shaft 78 and the crimp claw actuating stopper solenoid 214 for driving the crimp claw actuating stopper 128 and when the wrapping mode was selected and coin wrapping and counting were effected in the previous cycle, it outputs an open signal to the shutter solenoid 64. On the contrary, when the counting mode was selected and coin counting was effected in the previous cycle, since the shutter 9 is open, the CPU 200 does not output an open signal to the shutter solenoid 64 but outputs a drive signal to the motor 101 to move the wrapping rollers 86*a*, 86*b*, 86*c* from their most separated positions at the wrapping roller retracted positions RETP to the wrapping roller waiting positions WAITP corresponding to the coins of the denomination specified in the previous cycle.

The drive signal is output to the step motor 82 until the photosensor 81 detects the small cut portion 79*a* of the disk 80.

Accordingly, when the counting mode was selected and coin counting was effected in the previous cycle, the coin support post 70 is moved from the lower post retracted position to the post waiting position immediately below the shutter 9 and the wrapping rollers 86*a*, 86*b*, 86*c* are moved from the wrapping roller retracted positions to the wrapping roller waiting positions corresponding to the denomination of the coins to be wrapped.

On the other hand, when the wrapping mode was selected and coin wrapping and counting were effected in the previous cycle, the coin support post 70 is located at the post waiting position immediately below the shutter 9. Nevertheless, the cam shaft 78 is rotated by one cycle so that the coin support post 70 is lowered to the post retracted position and then elevated to the post waiting position immediately below the shutter 9.

Therefore, in the case where the wrapping mode was selected so as to effect coin wrapping and counting and coins remain in the coin temporary stacking section 7 above the shutter 9, since the shutter 9 opens the space between the pair of stacking blocks 8*a*, 8*b*, these coins are transferred onto the upper surface of the coin support post 70 located at the post waiting position. Then, the coin support post 70 is lowered to the post wrapping position and the coins transferred onto the upper surface of the coin support post 70 and the coins remaining on the upper surface of the coin support post 70 are held between the wrapping rollers 86*a*, 86*b*, 86*c* all together. The coin support post 70 is, then, moved to the post retracted position where it is retracted from the space between the wrapping rollers 86*a*, 86*b*, 86*c* and the wrapping rollers 86*a*, 86*b*, 86*c* are moved to the wrapping roller wrapping positions WRAPP. As a result, the spacing between the wrapping rollers 86*a*, 86*b*, 86*c* becomes great and the coins held between the wrapping rollers 86*a*, 86*b*, 86*c* fall in the space between the wrapping rollers 86*a*, 86*b*, 86*c*. Then, the coin support post 70 is moved from the post retracted position to the post waiting position immediately below the shutter 9.

On the other hand, the drive signal is output to the crimp claw actuating stopper solenoid 128 until the photosensor 81 detects the small cut portion 79*a* of the disk 80 and, therefore, the crimp claws (not shown) are held at the crimp claw retracted positions until the coin support post 70 has been moved to the post waiting position immediately below the shutter 9. Accordingly, if coins remain in the coin temporary stacking section 7 and/or on the upper surface of the coin support post 70 and, as a result, when the coin support post 70 is lowered from the post waiting position to the post retracted position with coins in a number which is less than the number of coins to be wrapped in a wrapped coin roll supported on the upper surface thereof and the coins are held between the wrapping rollers 86*a*, 86*b*, 86*c*, the crimp claws are held at the crimp claw retracted positions irrespective of the rotation of the cam shaft 78. Therefore, since the crimp claws are not moved to the crimping positions and the crimping operation is not effected, the coins are prevented from being damaged by the crimp claws and the crimping operation, and the coins held between the wrapping rollers 86*a*, 86*b*, 86*c* are prevented from being scattered by an undesirable force applied thereto.

When an open signal is output to the shutter solenoid 64, its output is maintained until a predetermined time period has passed after the clear switch 152 was operated, and the CPU 200 then outputs a close signal to close the shutter 9.

When the operator operates the denomination setting switch 154 and the selection switch 156 so as to select the denomination of the coins to be wrapped, the CPU 200 reads out the diameter, thickness and other such data regarding the selected coins from the ROM 201.

Based upon the coin data, the CPU 200 further outputs drive signals to the motor 30 for adjusting the spacing between the guide members 5, 6 and the motor 11 for adjusting the position of the transporting belt 10, thereby adjusting the spacing between the guide members 5, 6 and the position of the transporting belt 10. This adjustment is effected until the spacing between the guide members 5, 6 and the position of the transporting belt 10 determined based upon a passage width detection signal from the passage width detection switch 203 and a belt position detection signal from the belt position detection switch 204 coincide with a target spacing between the guide members 5, 6 and a target position of the transporting belt 10 corresponding to the diameter and the thickness of the coins of the denomination to be counted which are read out from the ROM 201. When the width of the coin sorting passage 4, namely, the spacing between the guide members 5, 6 is adjusted by the motor 30, the spacing between the stacking blocks 8*a*, 8*b* is synchronously adjusted in accordance with the selected denomination of the coins.

When the denomination setting switch 154 is operated and the selection switch 156 is operated to select the denomination of the coins to be wrapped, the CPU 200 reads out the wrapping roller waiting positions of the wrapping rollers 86*a*, 86*b*, 86*c* corresponding to the denomination of the coins and outputs a drive signal to the motor 101, thereby driving the motor 101 until, based on the spacing between the wrapping rollers 86*a*, 86*b*, 86*c* detected by the wrapping roller spacing detection switch 205, the wrapping rollers 86*a*, 86*b*, 86*c* are determined to be located at the wrapping roller waiting positions WAITP corresponding to the denomination of the coins.

When all preparatory operations have been completed in this manner, information indicating that coin wrapping can be effected is displayed on the display section 160 and the coin wrapping machine is ready for wrapping coins.

After the operator has deposited coins into the coin depositing section (not shown) and operated the start/stop switch 153, the coin counting operation is started.

More specifically, when the start/stop switch 153 is operated and a start signal is input to the CPU 200, the CPU 200 outputs drive signals to the rotatable disk motor 210 and the motor 19 and outputs a reverse rotation signal to the stopper solenoid 68. As a result, the rotatable disk motor 210 and the motor 19 arc forwardly driven and the stopper solenoid 68 rotates the stopper 67 so that the cut flat side surface thereof is flush with the inner surface of the guide member 6.

As a consequence, since the width of the coin sorting passage 4, namely, the spacing between the guide members 5, 6 has been adjusted so as to correspond to the diameter of the denomination of coins to be counted, the coins of the denomination to be counted and any smaller coins are fed from the rotatable disk 1 into the coin sorting passage 4, whereas coins having greater diameter than that of the coins of the denomination to be counted remain on the rotatable disk 1 and are not fed into the coin sorting passage 4.

On the other hand, the coins which have a smaller diameter than that of the coins of the denomination to be counted and have been fed into the coin sorting passage 4 fall downward between the guide members 5, 6 and are collected in a small coin collecting box (not shown).

Thus, only the coins of the denomination to be counted pass along the coin sorting passage 4 and are detected by the sensor 66. When the sensor 66 detects a coin, it outputs a coin detection signal to the CPU 200.

When the CPU 200 receives the coin detection signal from the sensor 66, it judges based upon the information about the state of the shutter 9 stored in the RAM 202 whether the shutter 9 is open or closed. In the area of the RAM 202 for storing the state of the shutter 9, "0" is stored when the shutter 9 is closed and "1" is stored when the shutter 9 is opened. If "0" is stored in the area of the RAM 202, i.e. if the shutter 9 is closed, the CPU 200 increases the number stored in the RAM 202 by one.

After the coins have passed by the sensor 66, they are fed into the coin temporary stacking section 7. Since each of the pair of stacking blocks 8*a*, 8*b* is formed such that the downstream portion thereof is higher than an upstream portion thereof, each coin fed in the coin sorting passage 4 is directed downward by collision with the second inner walls 8*a*-2, 8*b*-2 of the downstream portions of the stacking blocks 8*a*, 8*b*. Since the shutter 9 is closed, the coin is placed on the shutter 9.

When the CPU 200 judges that the number M of coins detected by the sensor 66 has become equal to the reference number M0 of coins to be stacked in the coin temporary stacking section 7, which number M0 is stored in the ROM 201, it outputs a drive signal to the shutter solenoid 64 to swing the shutter 9 about the shaft 63 and open it, whereby the space between the stacking blocks 8*a*, 8*b* is opened downward. Since the coin support post 70 is located at the position immediately below the shutter 9 at this time, the coin support post 70 can receive the coins stacked in the coin temporary stacking section 7 reliably on the upper surface thereof. The reference number M0 of coins to be stacked in the coin temporary stacking section 7 is predetermined based upon the thickness of the stacking blocks 8*a*, 8*b*. Thus, the shutter 9 is not opened until the predetermined number M0 of coins have been stacked in the coin temporary stacking section 7. This is to ensure that the upper surface of the coin support post 70 can reliably support the coins. More specifically, if the coins should not be stacked in the coin temporary stacking section 7 but be stacked directly on the upper surface of the coin support post 70, it would be difficult to stack coins in the desired manner, because the flat area provided by the upper surface of the coin support post 70 is not as large as that of the upper surface of the shutter 9 or of a coin. In this sense, it is sufficient to set at least one as the number of coins to be received in the coin temporary stacking section 7.

Thus, when the shutter 9 is opened, the CPU 200 stores "1" in the area of the RAM 202 for storing the state of the shutter 9 and reads out from the ROM 201 the number of pulses which have to be output to the step motor 82 for lowering the coin support post 70 by the thickness of one coin of the denomination to be wrapped.

Then, when the sensor 66 detects a coin, the CPU 200 outputs a drive signal to the step motor 82 and rotates the cam shaft 78 by the number of pulses read out from the ROM 201.

As a result, the coin support post 70 is lowered by the thickness of one coin to be wrapped.

When the CPU 200 judges based upon the coin detection signal from the sensor 66 that the number M0 of coins detected by the sensor 66 has become equal to the reference wrapping unit number W0 of coins to be wrapped in one wrapped coin roll which is stored in the ROM 201, it outputs drive stop signals to the rotatable disk motor 210 and the motor 19 to stop the rotation of the rotatable disk 1 and the drive of the transporting belt 10 and outputs a rotation signal to the stopper solenoid 68, thereby projecting the stopper 67 into the coin sorting passage 4 and preventing the following coins from being fed into the coin temporary stacking section 7.

Since at this time the coin support post 70 has not yet been lowered to the post wrapping position where the coins stacked on the upper surface thereof can be wrapped, the CPU 200 further lowers the coin support post 70. Moreover, since the coins in the number which are to be wrapped in one wrapped coin roll have already been stacked on the upper surface of the coin support post 70, it is no longer necessary to intermittently output pulse signals to the step motor 82 for controlling it in steps and, therefore, in preparation for producing the next wrapped coin roll, the CPU 200 outputs a continuous pulse signal to the step motor 82 until the photosensor 81 detects the small cut portion 79*a* of the disk 80.

When the CPU 200 detects, based on the number of pulses output to the step motor 82, that the coin support post 70 has reached the post wrapping position, it outputs a drive signal to the film feed motor 213 to rotate the film feed rollers 107*a*, 107*b*, thereby feeding the wrapping film 106 to the space between the wrapping rollers 86*a*, 86*b*, 86*c* and the stacked coins supported on the upper surface of the coin support post 70.

As is well known, when the film feed rollers 107*a*, 107*b* are rotated, the rotation force thereof is transmitted to the wrapping rollers 86*a*, 86*b*, 86*c* and the wrapping rollers 86*a*, 86*b*, 86*c* are rotated in synchronism with the rotation of the film feed rollers 107*a*, 107*b*.

Consequently, as shown in FIG. 10, the coin support post 70 is held at the post wrapping position, while the wrapping rollers 86*a*, 86*b*, 86*c* are moved from the wrapping roller waiting positions WAITP to the wrapping roller wrapping positions WRAPP where they are closer to each other, thereby holding the leading end portion of the wrapping film 106 between themselves and the stacked coins.

Then, in the well known manner, the rotation of the film feed rollers 107*a*, 107*b* is continued to feed the wrapping film 106 to the circumference of the stacked coins and the rotation of the wrapping rollers 86*a*, 86*b*, 86*c* is also continued, whereby the wrapping film 106 is wound around the stacked coins supported on the upper surface of the coin support post 70.

When the CPU 200 judges, based upon a detection signal from the wrapping film feed amount detection switch 206, that a length of the wrapping film 106 equal to about double the circumference of the stacked coins has been fed, it outputs a drive stop signal to the film feed motor 213, thereby stopping the rotation of the film feed rollers 107*a*, 107*b*, and outputs a drive signal to the wrapping roller motor 212, thereby rotating the wrapping rollers 86*a*, 86*b*, 86*c*. As is well known, the film feed rollers 107*a*, 107*b* are prevented from being rotated by a one-way clutch (not shown) when the wrapping rollers 86*a*, 86*b*, 86*c* are rotated by the wrapping roller motor 212.

The rotation speed of the wrapping rollers 86*a*, 86*b*, 86*c* rotated by the wrapping roller motor 212 is set greater than that of the wrapping rollers 86*a*, 86*b*, 86*c* rotated by the film feed motor 213. Therefore, since the wrapping film 106 is fed to the circumference of the stacked coins by the wrapping rollers 86*a*, 86*b*, 86*c* at a low speed, it is possible to wind the wrapping film 106 around the stacked coins reliably. On the other hand, since the wrapping rollers 86*a*, 86*b*, 86*c* arc rotated at a high speed after the wrapping film 106 has been wound around the stacked coins, it is possible for the crimp claws to reliably crimp the upper and lower end portions of the wrapping film 106 at a high speed.

Since the wrapping rollers 86*a*, 86*b*, 86*c* are rotated by the wrapping roller motor 212 after the film feed rollers 107*a*, 107*b* arc stopped, a tensile force is produced in the wrapping film 106 between the wrapping rollers 86*a*, 86*b*, 86*c* and the film feed rollers 107*a*, 107*b*. The wrapping film 106 is cut by the action of the tensile force pushing it against the cutter 109.

Since the step motor 82 further rotates the cam shaft 78 and the crimp claw actuating stopper 128 is not driven, the portion of the cam profile of the crimp claw retracting cam 123 against which the cam follower 122 abuts becomes concave, whereby the crimp claws (not shown) are moved from the crimp claw retracted positions to the space between the wrapping rollers 86*a*, 86*b*, 86*c*. Further, a crimping mechanism (not shown) is actuated by the crimp claw actuating cam 129 and the upper and lower end portions of the wrapping film 106 wound around the stacked coins arc crimped in the well-known manner to produce a wrapped coin roll including the predetermined number WO of coins.

Immediately before the crimp claws finish the crimping operation, the portion of the cam profile of the post elevating and lowering cam 77 against which the cam follower 76 abuts becomes further concave and, therefore, the coin support post 70 is further lowered from the post wrapping position. Since the portion of the cam profile of the post retracting cam 116 against which the cam follower 117 abuts becomes convex, the coin support post 70 is moved from the space between the wrapping rollers 86*a*, 86*b*, 86*c* to the post retracted position.

At the time the coin support post 70 begins to be lowered from the post wrapping position, the stacked coins are held between the wrapping rollers 86*a*, 86*b*, 86*c* and the upper and lower end portions of the wrapping film 106 arc being crimped by the crimp claws. There is therefore no risk of the stacked coins falling.

When the cam shaft 78 is further rotated by the step motor 82, the crimp claws are vertically moved apart from each other and are further moved to the crimp claw retracted positions by the crimp claw retracting cam 123.

Thus, at the time the cam shaft 78 has been rotated by 340 degrees, the portion of the cam profile of the first wrapping roller position adjusting cam 95 against which the cam follower 94 abuts becomes convex and, as a result, the three wrapping rollers 86*a*, 86*b*, 86*c* are moved apart from each other to the wrapping roller waiting positions WAITP.

Therefore, the roll-like stacked coins wrapped with the wrapping film 106 fall via the chute (not shown) to be collected in a wrapped coin collecting box (not shown).

The CPU 200 continues to output pulse signals to the step motor 82 until the photosensor 81 detects the small cut portion 79*a* of the disk 80 and the coin support post 70 is located at the post waiting position immediately below the shutter 9. It then stops outputting pulse signals. Simultaneously, the CPU 200 outputs drive signals to the rotatable disk motor 210, the motor 19 and the shutter solenoid 64, thereby rotating the rotatable disk 1, driving the transporting belt 10 and closing the shutter 9 and outputs a reverse rotation signal to the stopper solenoid 68 to rotate the stopper 67 so that the cut side surface of thereof is flush with the side surface of the guide member 6 on the side of the coin sorting passage 4, whereby coins can pass through the coin sorting passage 4.

At the same time, the CPU 200 causes the display section 160 to display information indicating that one wrapped coin roll has been produced. This completes one cycle of the wrapping operation.

The CPU 200 repeats the above operations until the start/stop switch 153 is operated again, until it judges that no coins to be wrapped remain when no coin detection signal has been input from the sensor 66 for a predetermined time period, until wrapped coin rolls have been produced in the number specified by operating the stop condition selection switch 155, or until coins have been wrapped in the number specified.

When the start/stop switch 153 is operated again, when it is judged that no coin to be wrapped remain when the coins detection signal has not been input from the sensor 66 for a predetermined time period, when wrapped coin rolls have been produced in the number specified using the stop condition selection switch 155, or when coins have been wrapped in the number specified, the CPU 200 outputs drive signals to the rotatable disk motor 210 and the motor 19, thereby stopping the rotatable disk 1 and the transporting belt 10, and outputs a rotation signal to the stopper solenoid 68 so as to project the stopper 67 into the coin sorting passage 4.

Simultaneously, the CPU 200 causes the display section 160 to display the number of wrapped coin rolls or the number of wrapped coins and the fact that the wrapping operation was completed.

According to this embodiment, when a predetermined number of coins have been stacked in the coin temporary stacking section 7, the shutter 9 is opened to send the stacked coins onto the upper surface of the coin support post 70 standing by immediately below the shutter 9. Then, each time a coin passes by the sensor 66, the coin support post 70 is lowered by the thickness of one coin and reaches the post wrapping position when coins in number W0 to be wrapped have been supported by the coin support post 70. Therefore, the coin stacking section for stacking coins of the number W0 to be wrapped which has to be provided in a prior art coin wrapping machine is not necessary and it is possible to considerably reduce the height of the coin wrapping machine with a simple structure. Further, since coins are fed to the coin temporary stacking section 7 for stacking coins in a known manner, it is possible to prevent coin jamming reliably. Moreover, since the stacked coins are wrapped by three wrapping rollers 86*a*, 86*b*, 86*c*, similar to that used in a prior art coin wrapping machine, it is possible to wrap coins in the desired manner.

Further, according to this embodiment, the first stacking block 8*a* of the pair of stacking blocks 8*a*, 8*b* movable relative to each other includes the first inner wall 8*a*-1 lying at the predetermined angle X to the direction in which the coin sorting passage 4 extends and the second inner wall 8*a*-2 lying at the predetermined angle –X to the above mentioned direction. Further, the second stacking block 8*b* of the pair of stacking blocks 8*a*, 8*b* includes the first inner wall 8*b*-1 and the second inner wall 8*b*-2, which are arranged such that the first inner wall 8*b*-1 and the first inner wall 8*a*-1 of the stacking block 8*a* arc formed symmetrically with respect to the center line of the coin sorting passage 4 and the second inner wall 8*b*-2 and the second inner wall 8*a*-2 of the stacking block 8*a* arc formed symmetrically with respect to the center line of the coin sorting passage 4. Consequently, the coins can be guided by four points on the inner walls 8*a*-1, 8*a*-2, 8*b*-1, 8*b*-2 of the stacking blocks 8*a*, 8*b* and are stacked due to the movement of the pair of stacking blocks relative to each other in accordance with the diameter of the coins to be wrapped, and therefore, the coins to be wrapped are stacked in the coin temporary stacking section 7 such that the center of the coins to be wrapped coincides with that of the upper surface of the coin support post 70 which is waiting below the coin temporary stacking section 7. Accordingly, it is possible to transport the stacked coins at the desired position on the upper surface of the coin support post 70 and to prevent the coins from being obliquely wrapped. In addition, since the second inner walls 8*a*-2, 8*b*-2 of the stacking blocks 8*a*, 8*b* are formed to be higher than the first inner walls 8*a*-1, 8*b*-1 thereof, the coins fed from the coin sorting passage 4 can collide with the second inner walls 8*a*-2, 8*b*-2 and be dropped reliably through the spacing between the pair of stacking blocks 8*a*, 8*b*.

The present invention has thus been shown and described with reference to specific embodiments. However, it should be noted that the present invention is in no way limited to the details of the described arrangements but changes and modifications may be made without departing from the scope of the appended claims.

Figure 16:
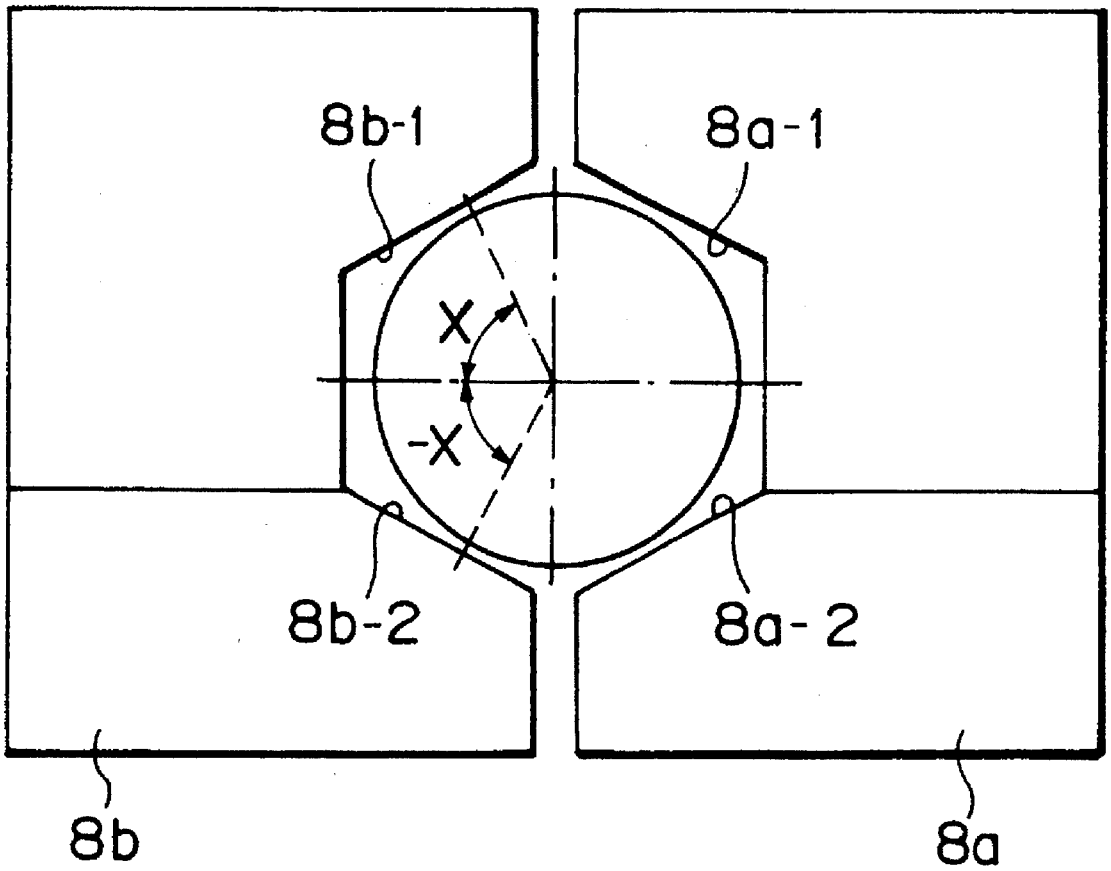
FIG. 16 is a schematic front view of stacking blocks used in the coin wrapping machine which is another embodiment of the present invention.

For example, FIG. 16 shows that it is possible to form the stacking blocks 8*a*, 8*b* such that a perpendicular line from the center of the coin to each of the first inner walls 8*a*-1, 8*b*-1 lies at an angle X of 60 degrees to a line drawn perpendicular line to the direction in which the coin sorting passage 4 extends and a perpendicular from the center of the coin to the second inner walls 8*a*-2, 8*b*-2 lies at an angle –X of –60 degrees to a line drawn perpendicular to the direction in which the coin sorting passage 4 extends, whereby the inside of the coin temporary stacking section 7 substantially forms a regular hexagon. Alternately, it is possible to form the stacking blocks 8*a*, 8*b* such that the above mentioned angle X is set to 30 degrees. Furthermore, the angle X is not limited to 30, 45 or 60 degrees but rather the stacking blocks 8*a*, 8*b* can be formed to satisfy the condition of 30<=X<=60

Furthermore, since it is sufficient for the coins stacked temporarily in the coin temporary stacking section 7 to be guided by four points on the first and second inner walls 8*a*-1, 8*b*-1, 8*a*-2, 8*b*-2 of the stacking blocks 8*a*, 8*b*, it is not necessary to provide the third inner walls 8*a*-3, 8*b*-3 of the stacking blocks 8*a*, 8*b*. Accordingly, the inner walls of the stacking blocks 8*a*, 8*b* may consist of the first and second walls 8*a*-1, 8*b*-1, 8*a*-2, 8*b*-2 so that the inside of the coin temporary stacking section 7 substantially forms a diamond when the stacking blocks 8*a*, 8*b* abut against each other. Moreover, in this specification and the appended claims, the respective means need not necessarily be physical means and arrangements whereby the functions of the respective means arc accomplished by software fall within the scope of the present invention. In addition, the function of a single means may be accomplished by two or more physical means and the functions of two or more means may be accomplished by a single physical means.

According to the present invention, it is possible to provide a coin wrapping machine which comprises a rotatable disk for receiving deposited coins and feeding out the received coins to a coin sorting passage by the centrifugal force produced by rotation thereof, the coin sorting passage being for passing coins of a predetermined denomination therethrough, coin stacking means for stacking coins to be wrapped, coin support post means for receiving coins stacked in the coin stacking means at a post waiting position immediately below the coin stacking means and supporting them on the upper surface thereof, coin wrapping means including a plurality of wrapping rollers for winding a wrapping film around the stacked coins supported by the coin support post means to wrap them and produce a wrapped coin roll, support post moving means for moving the coin support post means between a post waiting position immediately below the coin stacking means, a post wrapping position where the coins supported on the upper surface of the coin support post means can be wrapped by the coin wrapping means, and a post retracted position where the coin support post means is retracted from between the plurality of wrapping rollers. Moreover, wrapping roller moving means moves the plurality of wrapping rollers between wrapping roller wrapping positions where the coins are wrapped and wrapping roller retracted positions. Thus, coins of different denominations and having various diameters can be wrapped as desired by means of simple mechanisms.

We claim:

1. A coin wrapping machine comprising:

a rotatable disk for receiving deposited coins and feeding out said received coins to a coin sorting passage by a centrifugal force produced by rotation thereof, said coin sorting passage passing coins of a predetermined denomination only therethrough;

coin stacking means for stacking coins to be wrapped, said coin stacking means including a first stacking block means and a second stacking block means which are each movable relative to one another in a direction perpendicular to a vertical plane including a center line of said coin sorting passage, said first stacking block means and said second stacking block means forming a space therebetween in which coins are to be stacked, said first stacking block means including:

a first inner wall section lying vertically in a vertical direction in which coins are to be stacked and positioned at an angle X with respect to said vertical plane including said center line of said coin sorting passage, and a second inner wall section lying vertically in said vertical direction and positioned at an angle -X with respect to said vertical plane including said center line of said coin sorting passage, said second inner wall section having a height in said vertical direction larger than a height of said first inner wall section in said vertical direction, and said second stacking block means including:

a first inner wall section symmetrical to said first inner wall section of said first stacking block means with respect to said vertical plane including said center line of said coin sorting passage, and a second inner wall section symmetrical to said second inner wall section of said second stacking block means with respect to said vertical plane including said center line of said coin sorting passage;

coin support post means for receiving and supporting on an upper surface of said coin support post means coins stacked in said coin stacking means when at a post waiting position immediately below said coin stacking means;

coin wrapping means including a plurality of wrapping rollers, said coin wrapping means for winding a wrapping film around said stacked coins supported by said coin support post means, thereby wrapping said stacked coins and producing a wrapped coin roll;

support post moving means for moving said coin support post means between said post waiting position immediately below said coin stacking means, a post wrapping position where said stacked coins supported by said coin support post means can be wrapped by said coin wrapping means, and a post retracted position where said coin support post means is retracted from said plurality of wrapping rollers; and wrapping roller moving means for moving said plurality of wrapping rollers between respective wrapping roller wrapping positions where said stacked coins are wrapped and respective wrapping roller retracted positions.

2. A coin wrapping machine in accordance with claim 1, wherein said coin sorting passage is defined by a pair of guide members, said wrapping machine further comprising:

passage width adjusting means for moving said pair of guide members relative to each other to adjust a spacing between said pair of guide members; and stacking block spacing adjusting means for moving said first stacking block means and said second stacking block means relative to each other in accordance with an operation of said passage width adjusting means to adjust a spacing between said first stacking block means and said second stacking block means.

3. A coin wrapping machine in accordance with claim 2, wherein said stacking block spacing adjusting means moves said first stacking block means and said second stacking block means such that an amount of change in said spacing between said first stacking block means and said second stacking block means is (1/cos X) times a change in said spacing between said pair of guide members.

4. A coin wrapping machine in accordance with claim 3, wherein said angle X associated with said coin stacking means satisfies a condition of $30° \leqq X \leqq 60°$.

5. A coin wrapping machine in accordance with claim 4, wherein said angle X associated with said coin stacking means is approximately 45°.

6. A coin wrapping machine in accordance with claim 3, further comprising:

shutter means for opening and closing a bottom portion of said coin stacking means.

7. A coin wrapping machine comprising:

a rotatable disk for receiving deposited coins and feeding out said received coins to a coin sorting passage by a centrifugal force produced by rotation thereof, said coin sorting passage passing coins of a predetermined denomination only therethrough, said coin sorting passage being defined by a pair of guide members;

coin stacking means for stacking coins to be wrapped, said coin stacking means including a first stacking block means and a second stacking block means which are each movable relative to one another in a direction perpendicular to a vertical plane including a center line of said coin sorting passage, said first stacking block means and said second stacking block means forming a space therebetween in which coins are to be stacked, said first stacking block means including:

a first inner wall section lying vertically in a vertical direction in which coins are to be stacked and positioned at an angle X with respect to said vertical plane including said center line of said coin sorting passage, and a second inner wall section lying vertically in said vertical direction and positioned at an angle -X with respect to said vertical plane including said center line of said coin sorting passage, said second inner wall section having a height in said vertical direction larger than a height of said first inner wall section in said vertical direction, and said second stacking block means including:

a first inner wall section symmetrical to said first inner wall section of said first stacking block means with respect to said vertical plane including said center line of said coin sorting passage, and a second inner wall section symmetrical to said second inner wall section of said second stacking block means with respect to said vertical plane including said center line of said coin sorting passage;

coin support post means for receiving and supporting on an upper surface of said coin support post means coins stacked in said coin stacking means when at a post waiting position immediately below said coin stacking means;

coin wrapping means including a plurality of wrapping rollers, said coin wrapping means for winding a wrapping film around said stacked coins supported by said coin support post means, thereby wrapping said stacked coins and producing a wrapped coin roll;

support post moving means for moving said coin support post means between said post waiting position immediately below said coin stacking means, a post wrapping position where said stacked coins supported by said coin support post means can be wrapped by said coin wrapping means, and a post retracted position where said coin support post means is retracted from said plurality of wrapping rollers;

wrapping roller moving means for moving said plurality of wrapping rollers between respective wrapping roller wrapping positions where said stacked coins are wrapped and respective wrapping roller retracted positions;

passage width adjusting means for moving said pair of guide members relative to each other to adjust a spacing between said pair of guide members; and stacking block spacing adjusting means for moving said first stacking block means and said second stacking block means relative to each other in accordance with an operation of said passage width adjusting means to adjust a spacing between said first stacking block means and said second stacking block means, said stacking block spacing adjusting means moving said first stacking block means and said second stacking block means such that an amount of change in said spacing between said first stacking block means and said second stacking block means is (1/cos X) times a change in said spacing between said pair of guide members;

each of said first stacking block means and said second stacking block means including a third inner wall section lying parallel to said vertical plane including a center line of said coin sorting passage, whereby said first inner wall section, said second inner wall section, and said third inner wall section of said first stacking block means and said first inner wall section, said second inner wall section, and said third inner wall section of said second stacking block means form a hexagon in a horizontal plane perpendicular to said vertical direction when said first stacking block means and said second stacking block means come into abutment.

8. A coin wrapping machine in accordance with claim 1, wherein said angle X associated with said coin stacking means satisfies a condition of $30° \leqq X \leqq 60°$.

9. A coin wrapping machine in accordance with claim 8, wherein said angle X associated with said coin stacking means is approximately 45°.

10. A coin wrapping machine in accordance with claim 1, further comprising:

shutter means for opening and closing a bottom portion of said coin stacking means.

11. A coin wrapping machine comprising:

a rotatable disk for receiving deposited coins and feeding out said received coins to a coin sorting passage by a centrifugal force produced by rotation thereof, said coin sorting passage passing coins of a predetermined denomination only therethrough;

coin stacking means for stacking coins to be wrapped, said coin stacking means including a first stacking block means and a second stacking block means which are each movable relative to one another in a direction perpendicular to a vertical plane including a center line of said coin sorting passage, said first stacking block means and said second stacking block means forming a space therebetween in which coins are to be stacked, said first stacking block means including:

a first inner wall section lying vertically in a vertical direction in which coins are to be stacked and positioned at an angle X with respect to said vertical plane including said center line of said coin sorting passage, and a second inner wall section lying vertically in said vertical direction and positioned at an angle -X with respect to said vertical plane including said center line of said coin sorting passage, said second inner wall section having a height in said vertical direction larger than a height of said first inner wall section in said vertical direction, and said second stacking block means including:

a first inner wall section symmetrical to said first inner wall section of said first stacking block means with respect to said vertical plane including said center line of said coin sorting passage, and a second inner wall section symmetrical to said second inner wall section of said second stacking block means with respect to said vertical plane including said center line of said coin sorting passage;

coin support post means for receiving and supporting on an upper surface of said coin support post means coins stacked in said coin stacking means when at a post waiting position immediately below said coin stacking means;

coin wrapping means including a plurality of wrapping rollers, said coin wrapping means for winding a wrapping film around said stacked coins supported by said coin support post means, thereby wrapping said stacked coins and producing a wrapped coin roll;

support post moving means for moving said coin support post means between said post waiting position immediately below said coin stacking means, a post wrapping position where said stacked coins supported by said coin support post means can be wrapped by said coin wrapping means, and a post retracted position where said coin support post means is retracted from said plurality of wrapping rollers; and wrapping roller moving means for moving said plurality of wrapping rollers between respective wrapping roller wrapping positions where said stacked coins are wrapped and respective wrapping roller retracted positions;

each of said first stacking block means and said second stacking block means including a third inner wall section lying parallel to said vertical plane including a center line of said coin sorting passage, whereby said first inner wall section, said second inner wall section, and said third inner wall section of said first stacking block means and said first inner wall section, said second inner wall section, and said third inner wall section of said second stacking block means form a hexagon in a horizontal plane perpendicular to said vertical direction when said first stacking block means and said second stacking block means come into abutment.

* * * * *